US007720408B2

(12) United States Patent
Ueno et al.

(10) Patent No.: US 7,720,408 B2
(45) Date of Patent: May 18, 2010

(54) PROCESS CARTRIDGE, DEVELOPING CARTRIDGE AND ELECTROPHOTOGRAPHIC IMAGE FORMING APPARATUS

(75) Inventors: Takahito Ueno, Mishima (JP); Masaaki Sato, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 940 days.

(21) Appl. No.: 11/434,716

(22) Filed: May 17, 2006

(65) Prior Publication Data

US 2006/0269318 A1 Nov. 30, 2006

(30) Foreign Application Priority Data

May 27, 2005 (JP) ..... 2005-155091

(51) Int. Cl.
*G03G 15/08* (2006.01)
*G03G 21/16* (2006.01)

(52) U.S. Cl. ..... 399/103; 399/111

(58) Field of Classification Search ..... 399/102, 399/103, 105, 106, 111
See application file for complete search history.

(56) References Cited

U.S. PATENT DOCUMENTS

| | | | | |
|---|---|---|---|---|
| 5,585,889 | A | 12/1996 | Shishido et al. | 355/200 |
| 5,870,654 | A | 2/1999 | Sato et al. | 399/109 |
| 5,911,096 | A | 6/1999 | Batori et al. | 399/111 |
| 5,940,658 | A | 8/1999 | Yokoi et al. | 399/119 |
| 5,966,566 | A | 10/1999 | Odagawa et al. | 399/109 |
| 5,974,288 | A | 10/1999 | Sato | 399/119 |
| 6,104,894 | A | 8/2000 | Sato et al. | 399/106 |
| 6,131,007 | A | 10/2000 | Yamaguhci et al. | 399/256 |
| 6,185,390 | B1 | 2/2001 | Higeta et al. | 399/90 |
| 6,188,856 | B1 | 2/2001 | Sato | 399/119 |
| 6,381,420 | B1 | 4/2002 | Sato et al. | 399/27 |
| 6,385,416 | B1 | 5/2002 | Horikawa et al. | 399/111 |
| 6,608,980 | B2 | 8/2003 | Murayama et al. | 399/111 |
| 6,640,066 | B2 | 10/2003 | Sato | 399/106 |
| 6,665,506 | B1 * | 12/2003 | Wang et al. | 399/106 |

(Continued)

FOREIGN PATENT DOCUMENTS

JP 2000-131943 A 5/2000

(Continued)

*Primary Examiner*—David M Gray
*Assistant Examiner*—Joseph S Wong
(74) *Attorney, Agent, or Firm*—Fitzpatrick, Cella, Harper & Scinto

(57) ABSTRACT

A process cartridge is detachably mountable to a main assembly of an electrophotographic image forming apparatus and which is transportable in a state of being mounted to the main assembly of the apparatus. The cartridge includes an electrophotographic photosensitive member, a developing roller for developing an electrostatic latent image formed on the member with a developer, a developer accommodating portion accommodating the developer and having a developer supply opening for permitting passage of the developer to supply the developer to the roller, a sealing member unsealably sealing the opening and a grip member, provided on the sealing member, for being gripped to unseal the opening when the sealing member is removed from the opening. The grip member is movable between a first position where the cartridge can move to a predetermined position in the main assembly to permit transportation of the cartridge when mounted to the main assembly, and a second position where the cartridge is prevented from moving to the predetermined position from the first position when the cartridge is dismounted from the predetermined position.

16 Claims, 15 Drawing Sheets

U.S. PATENT DOCUMENTS

| | | | | |
|---|---|---|---|---|
| 6,714,749 | B2 | 3/2004 | Sato et al. | 399/102 |
| 6,823,153 | B2 | 11/2004 | Ueno et al. | 399/103 |
| 6,898,399 | B2 | 5/2005 | Morioka et al. | 399/167 |
| 6,937,832 | B2 | 8/2005 | Sato et al. | 399/111 |
| 6,968,146 | B1 | 11/2005 | Fujita et al. | 399/258 |
| 6,978,099 | B2 | 12/2005 | Ueno et al. | 399/103 |
| 7,139,502 | B2 | 11/2006 | Koishi et al. | 399/93 |
| 7,155,140 | B2 | 12/2006 | Arimitsu et al. | 399/111 |
| 7,174,122 | B2 | 2/2007 | Fujita et al. | 399/258 |
| 7,200,349 | B2 | 4/2007 | Sato et al. | 399/111 |
| 7,224,925 | B2 | 5/2007 | Sato et al. | 399/163 |
| 2005/0069338 | A1* | 3/2005 | Oguma et al. | 399/90 |
| 2005/0191084 | A1* | 9/2005 | Murakami | 399/103 |
| 2006/0008289 | A1 | 1/2006 | Sato et al. | 399/106 |
| 2006/0228127 | A1 | 10/2006 | Miyabe et al. | 399/90 |
| 2006/0251445 | A1 | 11/2006 | Ueno et al. | 399/102 |
| 2006/0269318 | A1 | 11/2006 | Ueno et al. | 399/106 |
| 2006/0285878 | A1 | 12/2006 | Arimitsu et al. | 399/111 |
| 2007/0053722 | A1 | 3/2007 | Sato et al. | 399/258 |
| 2007/0098453 | A1 | 5/2007 | Fujita et al. | 399/258 |

FOREIGN PATENT DOCUMENTS

| | | |
|---|---|---|
| JP | 2005-31391 A | 2/2005 |

* cited by examiner (a) COMPLETELY ACCOMMODATED STATE (b) MOUNTED IN THE MAIN ASSEMBLY (c) REMOVED FROM THE MAIN ASSEMBLY

PROCESS CARTRIDGE, DEVELOPING CARTRIDGE AND ELECTROPHOTOGRAPHIC IMAGE FORMING APPARATUS

FIELD OF THE INVENTION AND RELATED ART

The present invention relates to a process cartridge and a development cartridge, which are removably mountable in the main assembly of an electrophotographic image forming apparatus and are transportable while remaining mounted in the main assembly of the image forming apparatus. It also relates to an image forming apparatus which employs these cartridges.

In the field of an electrophotographic image forming apparatus, a process cartridge system has long been employed. According to a process cartridge system, an electrophotographic photosensitive member, and one or more processing means are integrally disposed in a cartridge, making it possible for a user himself or herself to maintain an electrophotographic image forming apparatus without relying on service personnel at all. Thus, a process cartridge system can drastically improve an electrophotographic image forming apparatus in operability. Therefore, a process cartridge system has been widely used in the field of an electrophotographic image forming apparatus.

A process cartridge (which hereinafter will be referred to as "cartridge") such as the one described above is provided with a sealing member, with which the developer supply outlet of the developer storage portion of the process cartridge is sealed to prevent the developer in the developer storage portion from entering the photosensitive drum side of the process cartridge during the shipment of the cartridge. Thus, before a brand new cartridge is used for the first time, a user is to detach a handgrip connected to the abovementioned sealing member, from the cartridge frame, and pull the handgrip to pull out, that is, to peel away, the sealing member by gripping the handgrip, to unseal the developer supply outlet to make it possible for the developer to be supplied to the development roller. Then, the process cartridge is to be mounted into the image forming apparatus main assembly.

As for the method of packaging an image forming apparatus and a cartridge (cartridges) to transport them, it has been a common practice to separately pack the main assembly of an image forming apparatus from a process cartridge (process cartridges) therefor, that is, to pack the former in one box, and the latter in another box. However, in recent years, in order to improve an image forming apparatus in terms of transportation efficiency, such an image forming apparatus transporting method that transports the main assembly of an image forming apparatus and the process cartridge(s) therefor together, with the cartridge(s) kept mounted in the image forming apparatus main assembly, has come to be employed (this method hereinafter may be referred to as "cartridge embedded image forming apparatus transporting method").

While a process cartridge or a development cartridge is transported while remaining mounted in the main assembly of an image forming apparatus, it is subjected to external forces that result from vibrations or the like. Therefore, various structural arrangements have been proposed to prevent the abovementioned handgrip connected to a sealing member from being separated from the frame of the process cartridge or developer cartridge by the external forces to which the handgrip is subjected. Examples of such proposals are disclosed in Japanese Laid open Patent Applications 2000 131943 and 2005 31391.

SUMMARY OF THE INVENTION

The present invention is one of the further developments of the abovementioned prior arts.

The primary object of the present invention is to provide a process cartridge or a developer cartridge, the developer supply outlet of which, for transportation purposes, is kept sealed with a sealing member, whose handgrip is easier to handle when the process cartridge or developer cartridge is removed from the main assembly of an image forming apparatus.

Another object of the present invention is to provide a process cartridge and a developer cartridge, which can be left mounted in the main assembly of an electrophotographic image forming apparatus during the transportation of the image forming apparatus, and which ensures that if a user forgets to remove the sealing member before remounting the process cartridge into the main assembly, the user is reminded that the sealing member must be removed before the cartridge is remounted into the main assembly.

According to an aspect of the present invention, there is provided a process cartridge which is detachably mountable to a main assembly of an electrophotographic image forming apparatus and which is transportable in a state of being mounted to the main assembly of the electrophotographic image forming apparatus, the process cartridge comprising an electrophotographic photosensitive member; a developing roller for developing an electrostatic latent image formed on the electrophotographic photosensitive member with a developer; a developer accommodating portion accommodating the developer and having a developer supply opening for permitting passage of the developer to supply the developer to the developing roller; a sealing member unsealably sealing the developer supply opening; and a grip member, provided on the sealing member, for being gripped to unseal the developer supply opening when the sealing member is removed from the developer supply opening, wherein the grip member is movable between a first position where the process cartridge is permitted to move to a predetermined position in the main assembly of the apparatus to permit transportation of the process cartridge in the state of being mounted to the main assembly of the electrophotographic image forming apparatus, and a second position where the process cartridge is prevented from moving to the predetermined position from the first position when the process cartridge is dismounted from the predetermined position.

According to another aspect of the present invention, there is provided a developing cartridge which is detachably mountable to a main assembly of an electrophotographic image forming apparatus and which is transportable in a state of being mounted to the main assembly of the electrophotographic image forming apparatus, the process cartridge comprising: a developing roller for developing an electrostatic latent image formed on electrophotographic photosensitive member with a developer; a developer accommodating portion accommodating the developer and having a developer supply opening for permitting passage of the developer to supply the developer to the developing roller; a sealing member unsealably sealing the developer supply opening; and a grip member, provided on the sealing member, for being gripped to unseal the developer supply opening when the sealing member is removed from the developer supply opening, wherein the grip member is movable between a first position where the developing cartridge is permitted to move to a predetermined position in the main assembly of the apparatus to permit transportation of the developing cartridge in the state of being mounted to the main assembly of the electrophotographic image forming apparatus, and a second position where the developing cartridge is prevented from moving to the predetermined position from the first position when the developing cartridge is dismounted from the predetermined position.

According to a further aspect of the present invention, there is provided an electrophotographic image forming apparatus for forming an image on a recording material, to which a process cartridge is detachably mountable, the apparatus comprising (a) a process cartridge including, an electrophotographic photosensitive member, a developing roller for developing an electrostatic latent image formed on the electrophotographic photosensitive member with a developer, a developer accommodating portion accommodating the developer and having a developer supply opening for permitting passage of the developer to supply the developer to the developing roller, a sealing member unsealably sealing the developer supply opening, and a grip member, provided on the sealing member, for being gripped to unseal the developer supply opening when the sealing member is removed from the developer supply opening, wherein the grip member is movable between a first position where the process cartridge is permitted to move to a predetermined position in the main assembly of the apparatus to permit transportation of the process cartridge in the state of being mounted to the main assembly of the electrophotographic image forming apparatus, and a second position where the process cartridge is prevented from moving to the predetermined position from the first position when the process cartridge is dismounted from the predetermined position; and (b) feeding means for feeding a recording material.

According to a further aspect of the present invention, there is provided an electrophotographic image forming apparatus for forming an image on a recording material, to which a process cartridge is detachably mountable, the apparatus comprising (a) a developing cartridge including, a developing roller for developing an electrostatic latent image formed on electrophotographic photosensitive member with a developer, a developer accommodating portion accommodating the developer and having a developer supply opening for permitting passage of the developer to supply the developer to the developing roller, a sealing member unsealably sealing the developer supply opening, and a grip member, provided on the sealing member, for being gripped to unseal the developer supply opening when the sealing member is removed from the developer supply opening, wherein the grip member is movable between a first position where the developing cartridge is permitted to move to a predetermined position in the main assembly of the apparatus to permit transportation of the developing cartridge in the state of being mounted to the main assembly of the electrophotographic image forming apparatus, and a second position where the developing cartridge is prevented from moving to the predetermined position from the first position when the developing cartridge is dismounted from the predetermined position; and (b) feeding means for feeding a recording material.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Next, the process cartridge in this embodiment, and an electrophotographic image forming apparatus which employs the process cartridge, will be described with reference to the appended drawings.

[General Structure of Multicolor Image Forming Apparatus]

Figure 1:
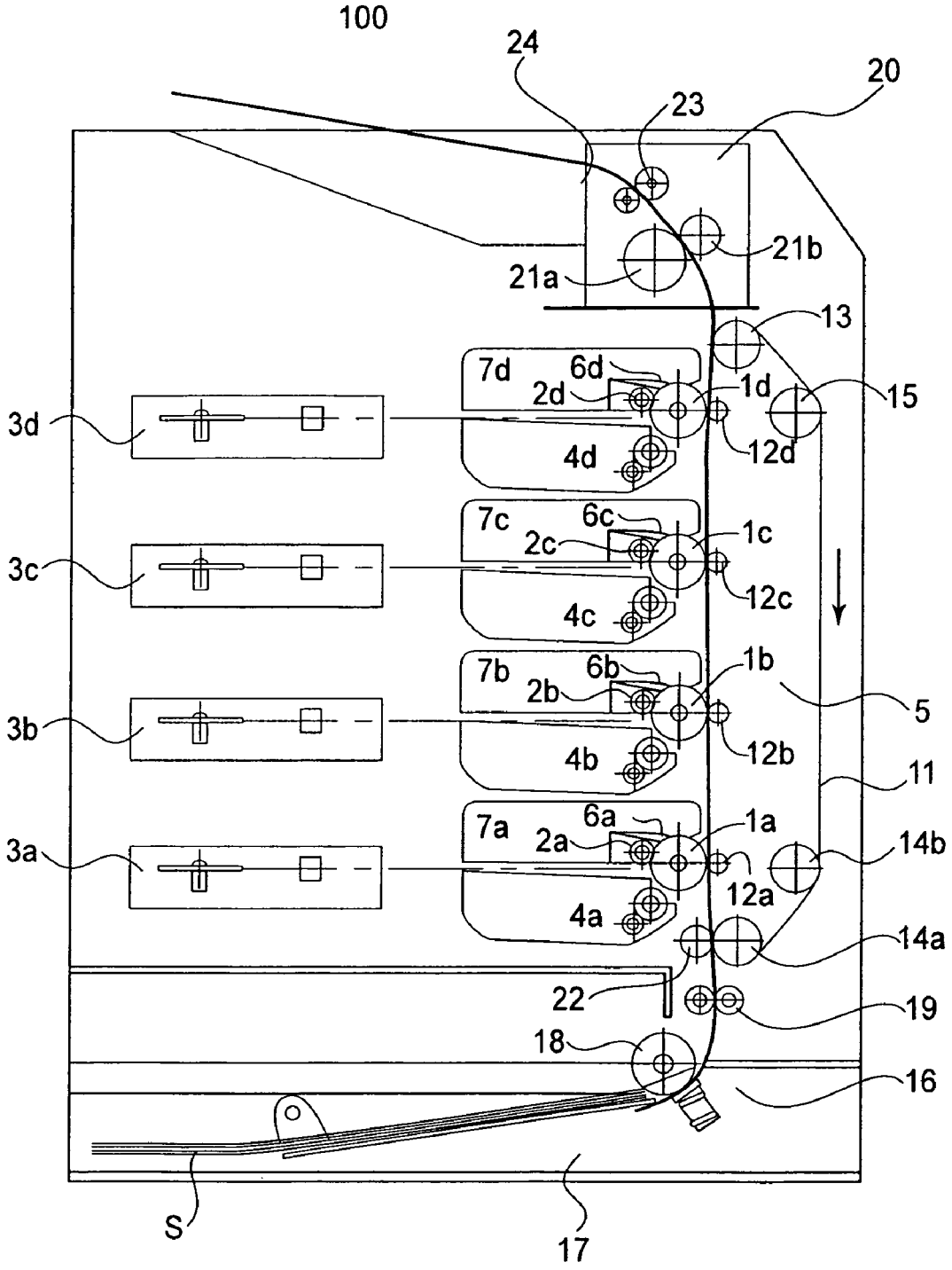
FIG. 1 is a vertical sectional view of the multicolor image forming apparatus in the first embodiment of the present invention.

First, referring to FIG. 1, the general structure of the multicolor image forming apparatus will be roughly described. FIG. 1 is a vertical sectional view of a full color laser beam printer as an example of a multicolor image forming apparatus, showing the general structure thereof.

The electrophotographic image forming apparatus main assembly 100 (which hereafter will be referred to as apparatus main assembly) in FIG. 1 is provided with four electrophotographic photosensitive drums 1 (1*a*, 1*b*, 1*c*, and 1*d*), which are electrophotographic photosensitive members in the form of a drum. The electrophotographic photosensitive drums 1 are vertically stacked in parallel. Each photosensitive drum 1 (which hereinafter will be referred to as photosensitive drum) is rotationally driven by a driving means (unshown) in the counterclockwise direction of the drawing. In the adjacencies of the peripheral surface of the photosensitive drum 1, a charging means 2 (2*a*, 2*b*, 2*c*, and 2*d*), a developing apparatus 4 (4*a*, 4*b*, 4*c*, and 4*d*), an electrostatic transferring apparatus 5, a cleaning apparatus (6*a*, 6*b*, 6*c*, and 6*d*), etc., are disposed, listing from the upstream side in terms of the rotational direction of the photosensitive drum 1. The charging means 2 uniformly charges the peripheral surface of the photosensitive drum 1. The development unit 4 develops the electrostatic latent image formed on the photosensitive drum 1 into a developer image, that is, an image formed of developer, by adhering developer to the electrostatic latent image. The electrostatic transferring apparatus 5 transfers the toner image on the photosensitive drum 1 onto a recording medium S. The cleaning apparatus removes the developer remaining on the peripheral surface of the photosensitive drum 1 after the transfer of the developer image.

Here, the photosensitive drum 1, the charging means 2, the developing apparatus 4, and the cleaning apparatus are integrally disposed in a cartridge, making up a process cartridge 7 (which hereafter will be referred to as "cartridge".

Disposed in the rear portion of the apparatus main assembly 100 are scanner units (3*a*, 3*b*, 3*c*, and 3*d*), each of which forms a latent image on the corresponding photosensitive drum 1 by selectively exposing numeral points of the peripheral surface of the photosensitive drum, based on image formation information.

The electrostatic transferring apparatus 5 is provided with an electrostatic transfer belt 11 (which hereafter will be referred to as a "belt"), which is disposed so that it opposes all of the photosensitive drums 1*a*, 1*b*, 1*c*, and 1*d* and circularly moves in contact with all of the photosensitive drums 1. As the material for the belt 11, a resin film, a multilayer film made up of a substrate layer formed of rubber and a resin layer formed on the substrate layer, or the like is used. The belt 11 is stretched around a driver roller 13, follower rollers 14*a* and 14*b*, and a tension roller 15. The belt 11 circularly moves so that the recording medium S is electrostatically adhered to the outward surface of the belt 11, in terms of the loop which the belt 11 forms, by the bias applied to an electrostatic adhesion roller 22, and also, so that the recording medium S is placed in contact with the abovementioned photosensitive drums 1. As the belt 11 moves as described above, the recording medium S is conveyed by the belt 11 to each of the transfer areas, in which the toner image on the photosensitive drum 1 is transferred onto the recording medium S.

The electrostatic transferring apparatus 5 is also provided with transfer rollers (12*a*, 12*b*, 12*c*, and 12*d*), which are disposed in parallel and in contact with the inward surface of the belt 11, in terms of the belt loop, in the areas in which they oppose the four photosensitive drums 1*a*, 1*b*, 1*c*, and 1*d*, respectively. During a transfer operation, bias which is opposite in polarity to the developer image on each photosensitive drum 1, is applied to these transfer rollers whereby the developer image on each photosensitive drum 1 is transferred onto the recording medium S.

The feeding-and-conveying portion 16 is the portion of the apparatus main assembly 100, which feeds the recording medium S into the main assembly 100 and conveys it to the image forming portion. The feeding and conveying portion 16 and the abovementioned belt 11 make up the conveying means for conveying the recording medium S. The feeding and conveying portion 16 holds a feeder cassette 17 in which multiple recording media S are stored. During an image forming operation, a feeding-and-conveying roller 18 (a roughly semicylindrical roller) and a pair of registration rollers 19 are rotationally driven in synchronism with the progression of the image forming operation. More specifically, as the feeding and conveying roller 18 is rotated, the recording media S in the cassette 17 are fed into the main assembly 100 while being separated one by one, and are conveyed to the belt 11 in synchronism with the rotation of the conveyer belt 11 and the resultant movement of the image writing start line of the recording medium S.

The fixing portion 20 is the portion for fixing the multiple developer images different in color to the recording medium S after the transfer of the developer images onto the recording medium S. The fixing portion 20 has a rotatable heat roller 21*a*, and a rotatable pressure roller 21*b* kept pressed upon the heat roller 21*a* to apply heat and pressure to the recording medium S.

The image forming operation carried out by the above described image forming apparatus is as follows: First, the process cartridges 7*a*, 7*b*, 7*c*, and 7*d* sequentially begin to be driven in synchronism with the printing timing. Thus, the photosensitive drums 1*a*, 1*b*, 1*c*, and 1*d* sequentially begin to be driven in the counterclockwise direction, and at the same time, the scanner units which correspond in position to the process cartridges 7 begin to be driven, one for one. As the results of this driving of the process cartridges 7, an electrostatic latent image is formed on the uniformly charged peripheral surface of each photosensitive drum 1. Each latent image is developed by the corresponding developing apparatus 4, with the use of toner.

Meanwhile, in synchronism with the progression of the image forming operation, the recording medium S is conveyed by the conveying means to each of the areas, in which the recording medium S faces the photosensitive drum 1, and is conveyed through the areas. While the recording medium S is conveyed through the areas, transfer bias is applied to the transfer rollers (12*a*, 12*b*, 12*c*, and 12*d*), which oppose the photosensitive drums 1, one for one, with the belt 11 remaining pinched between the transfer rollers and photosensitive drums 1. As a result, the developer images, different in color, on the photosensitive drums 1, one for one, are transferred in layers onto the recording medium S, effecting a single color image on the recording medium S.

After the transfer of the four monochromatic developer images different in color onto the recording medium S, the recording medium S is separated from the belt 11 with the utilization of the curvature of the belt driver roller 13, and is conveyed into the fixing portion 20, in which the developer images are thermally fixed to the recording medium S. Thereafter, the recording medium S is discharged from the apparatus main assembly 100 by a pair of discharge rollers 23 through a recording medium outlet 24, with the image bearing surface of the recording medium S facing downward.

(Structure of Process Cartridge)

Figure 2:
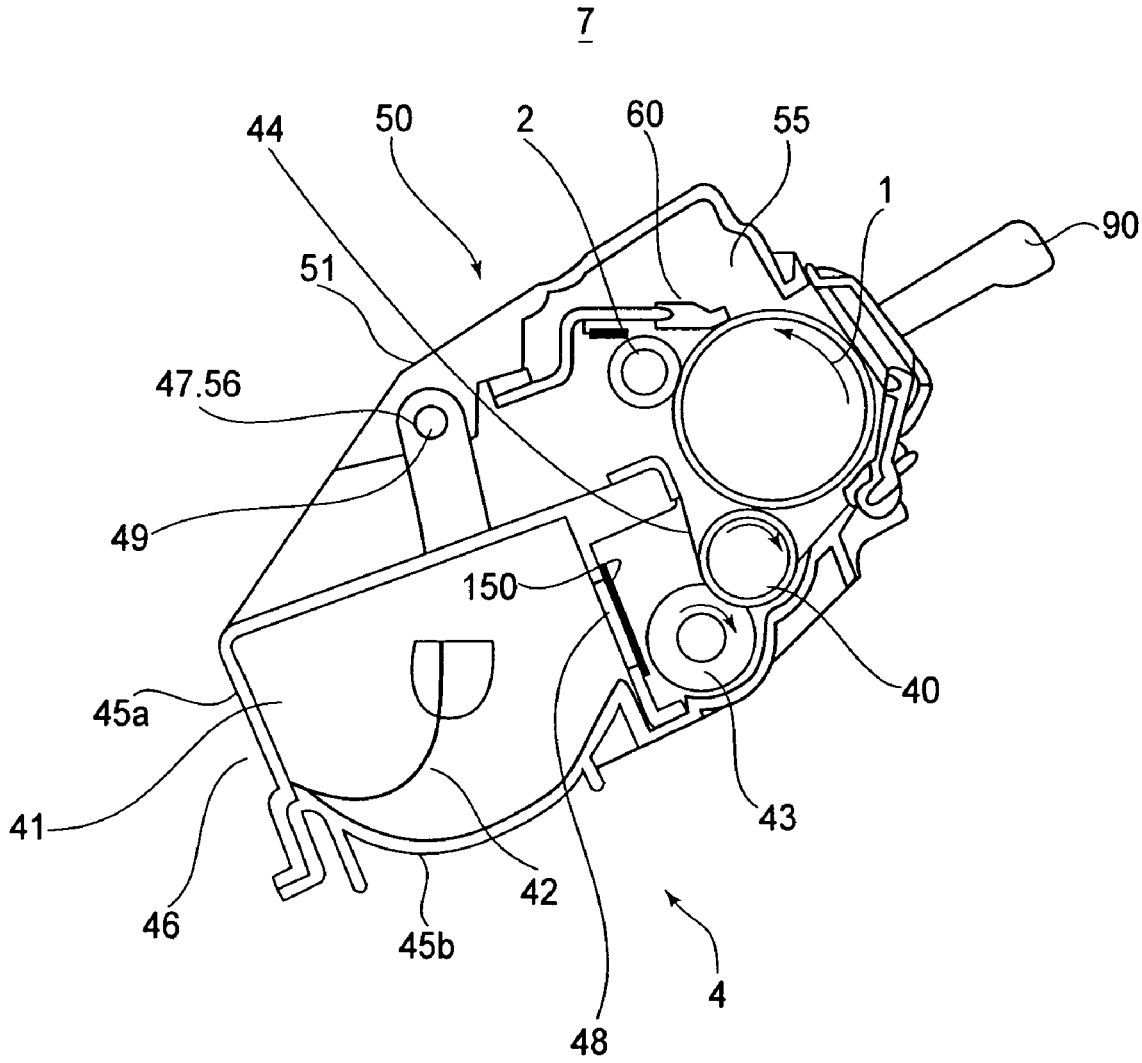
FIG. 2 is a cross-sectional view of the cartridge in the first embodiment of the present invention.
Figure 3:
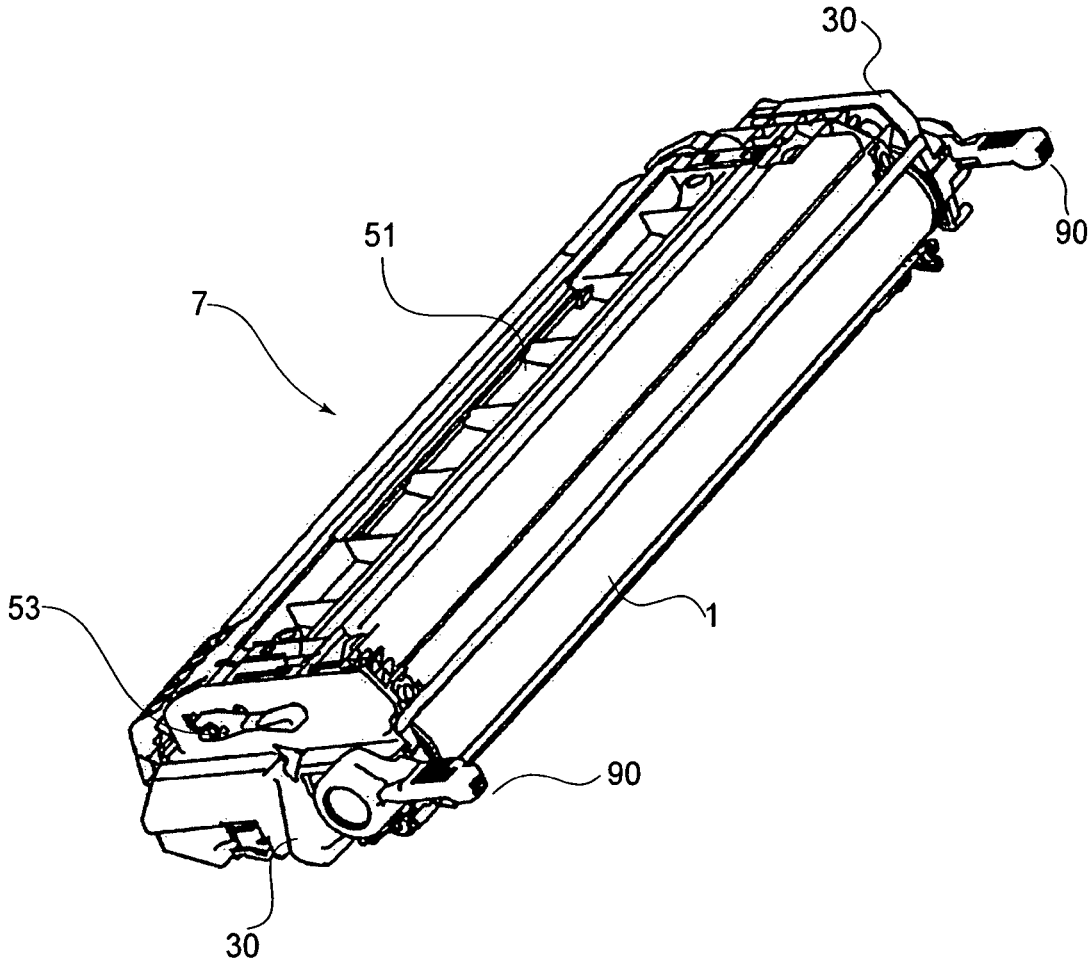
FIG. 3 is a perspective view of the cartridge in the first embodiment of the present invention.

Next, referring to FIGS. 2 and 3, the process cartridge in this embodiment will be described in detail. FIGS. 2 and 3 are cross sectional and perspective views, respectively, of the process cartridge 7 which stores developer. Incidentally, the process cartridges 7*a*, 7*b*, 7*c*, and 7*d* storing the developers of yellow, magenta, cyan, and black colors, respectively, are identical in structure. The cartridge shown in FIGS. 2 and 3 has a developer storage portion 41 in which the developer of yellow color is stored. The developer storage portion 41 will be described later. The rest of the developers different in color are stored in the developer storage portions 41 of the cartridges 7*b*, 7*c*, and 7*d*, respectively.

Each process cartridge 7 is separable into a cleaner unit 50, and a development unit 4. The cleaner unit 50 is provided with the photosensitive drum 1, charging means, and cleaning means. The development unit 4 constitutes the developing apparatus for developing an electrostatic latent image on the photosensitive drum 1.

The cleaner unit 50 is provided with a frame 51, to which the photosensitive drum 1 is rotatably attached, with bearing members placed between the frame 51 and photosensitive drum 1. In the adjacencies of the peripheral surface of the photosensitive drum 1, the primary charging means 2 and a cleaning blade 60 (which hereafter will be referred to as a "blade") are disposed. The primary charging means 2 is for uniformly charging the photosensitive layer of the photosensitive drum 1, which constitutes the peripheral layer of the photosensitive drum 1. The cleaning blade 60 is for removing the developer remaining on the peripheral surface of the photosensitive drum 1 after the image transfer. After being removed from the peripheral surface of the photosensitive drum 1 by the blade 60, the residual developer is stored in a chamber 55 for removed residual developer located above the blade 60.

The development unit 4 is made up of a development roller 40 which rotates in the direction indicated by an arrow mark, with a minuscule gap retained between the development roller 40 and photosensitive drum 1, and development unit frames 45*a* and 45*b*, in which developer is stored.

The development unit frames 45*a* and 45*b* are joined (by ultrasonic welding or the like method) to form the developing means container unit 46.

The development roller 40 is rotatably supported by the developing means container unit 46, with the interposition of bearing members. In the adjacencies of the peripheral surface of the development roller 40, a toner supply roller 43, which rotates in contact with the development roller 40 in the direction indicated by an arrow mark, and a development blade 44, are disposed. Further, in the developing container unit 46, a developer conveyance mechanism 42 is disposed, which is for conveying the developer in the developing means container unit 46, to the toner supply roller 43 while stirring it.

The development unit 4 is attached to the cleaner unit 50 so that the development unit 4 is suspended from the cleaner unit 50 in a manner to be pivotally movable relative to the cleaner unit 50. More specifically, the connective holes 47, with which the lengthwise end portions of the developing means container unit 46 are provided one for one, are aligned with the development unit supporting holes 56, with which the lengthwise end portions of the cleaner unit frame 51 of the cleaner unit 50 are provided, one for one. Then, a pair of pins 49 are inserted from the lengthwise end portions of the cleaner unit frame 51.

Further, the development unit 4 is kept biased by pressure application springs (unshown) so that the development roller 40, which is rotatable about the axial lines of the supportive holes, is kept in contact with the photosensitive drum 1.

[Structure Arrangement for Mounting Cartridge into Apparatus Main Assembly]

Figure 4:
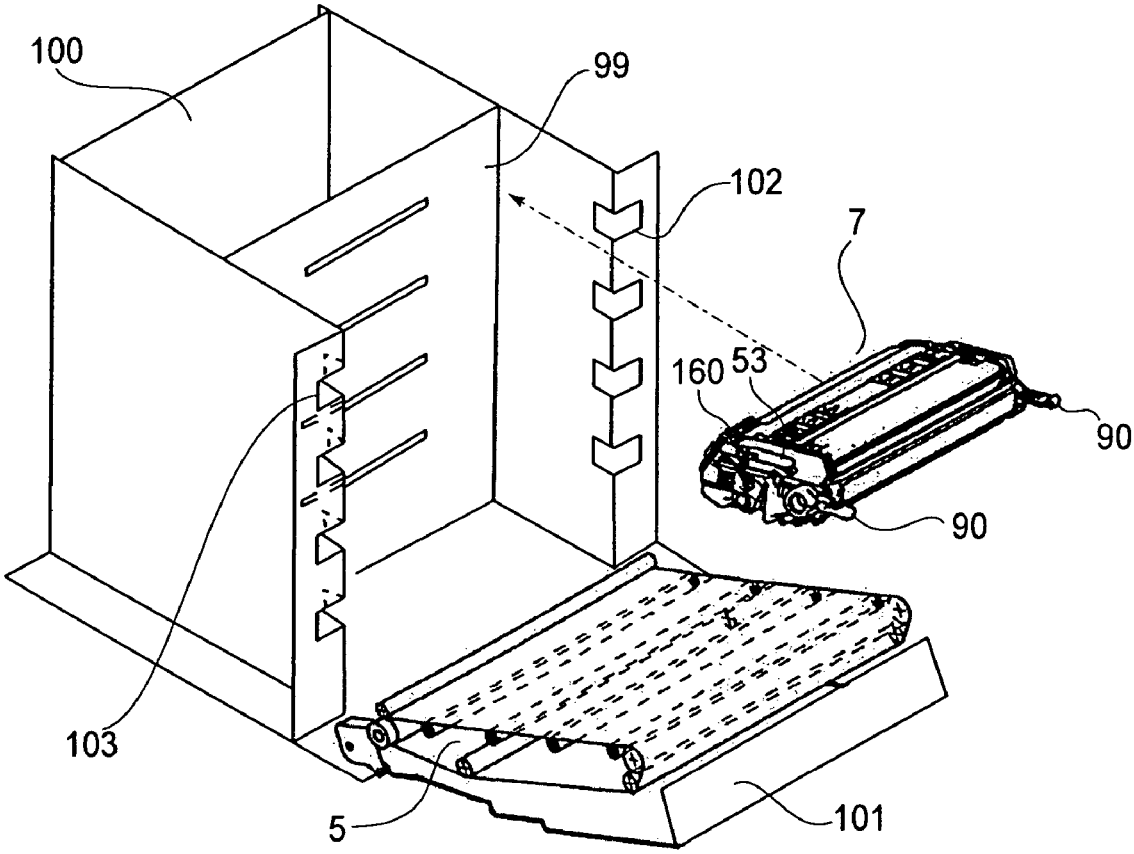
FIG. 4 is a schematic perspective view of the main assembly of the image forming apparatus, and one of the cartridges therefor, which is being mounted into the main assembly.

Next, referring to FIG. 4, the cartridge bays 99 of the apparatus main assembly 100, into which the cartridges 7 are mounted will be described. As shown in FIG. 4, the image forming apparatus main assembly 100 is provided with a front door 101, which is rotatably attached to the apparatus main assembly 100. Behind the front door 101, the electrostatic transferring apparatus 5 is rotatably disposed. It is when the front door 101 and electrostatic transferring apparatus 5 are in the open position that each of the cartridges 7 are removably mountable in the image forming apparatus main assembly 100. Each cartridge 7 is provided with a pair of handgrips 90, which are located at the lengthwise ends of the cartridge 7, near the photosensitive drum supporting portions of the cartridge 7, one for one. When the cartridge 7 is mounted or removed, the cartridge 7 is to be held so that the handgrips 90 protrudes toward the front door 101.

The image forming apparatus main assembly 100 is provided with a pair of internal guide rails 102 and 103 (unshown), and the cartridge 7 is provided with a pair of insert guides 53 (FIG. 3 as well as FIG. 4). The engagement of the insert guides 53 of the process cartridge 7 with the guide rails 102 and 103 of the image forming apparatus main assembly 100 makes it possible for the process cartridge 7 to be mounted into, or removed from, the image forming apparatus main assembly 100.

As a user closes the front door 101 after the completion of the mounting of the cartridges 7, pressure (unshown) is applied to the cartridges 7. As the pressure is applied, the cartridges 7 are correctly positioned relative to the apparatus main assembly 100 by the driving force transmitted to the cartridges 7 during an image forming operation.

[Handgrip Attached to Sealing Member of Developer Supply Outlet]

The developer storage portion is provided with a developer outlet, through which the development roller is supplied with the developer in the developer storage portion. The developer outlet of a brand new cartridge 7 has a sealing member for keeping the outlet sealed. This sealing member is provided with a handgrip. Next, the structure of this handgrip will be described.

Referring to FIG. 2, the development unit 4 is made up of the development unit frames 45*a* and 45*b*, which are joined. It is provided with a developer outlet 48 (which hereafter may be referred to simply as the opening) through which the developer in the developer storage portion 41 is conveyed to supply the development roller 40 with the developer. This opening 48 is kept sealed with a removably sealing member 150 (which hereafter will be referred to as a toner seal) until a user uses the cartridge 7 for the first time. This toner seal 150 is provided with a handgrip 160, which is attached to one end of the toner seal 150 (FIG. 6(*b*)).

The toner seal 150 is a strip of film of a substantial length, and is welded to the fringe of the opening 48 of the development unit frame 45*a*, keeping it there by the opening 48. More specifically, the toner seal 150 is welded to the fringe of the opening 48, starting from one lengthwise end (first lengthwise end) of the opening 48 to the other (second lengthwise end), at which it is doubled back toward the opposite lengthwise end, or the first lengthwise end. The doubled portion of the toner seal 150 is extended beyond the first lengthwise end, being exposed from the bearing member 30, which is a part of the cartridge frame. To the end of this doubled portion of the toner seal 150, the handgrip 160, which a user is to grip when the use wants to remove the toner seal 150 to unseal the opening 48, is attached.

Figure 5:
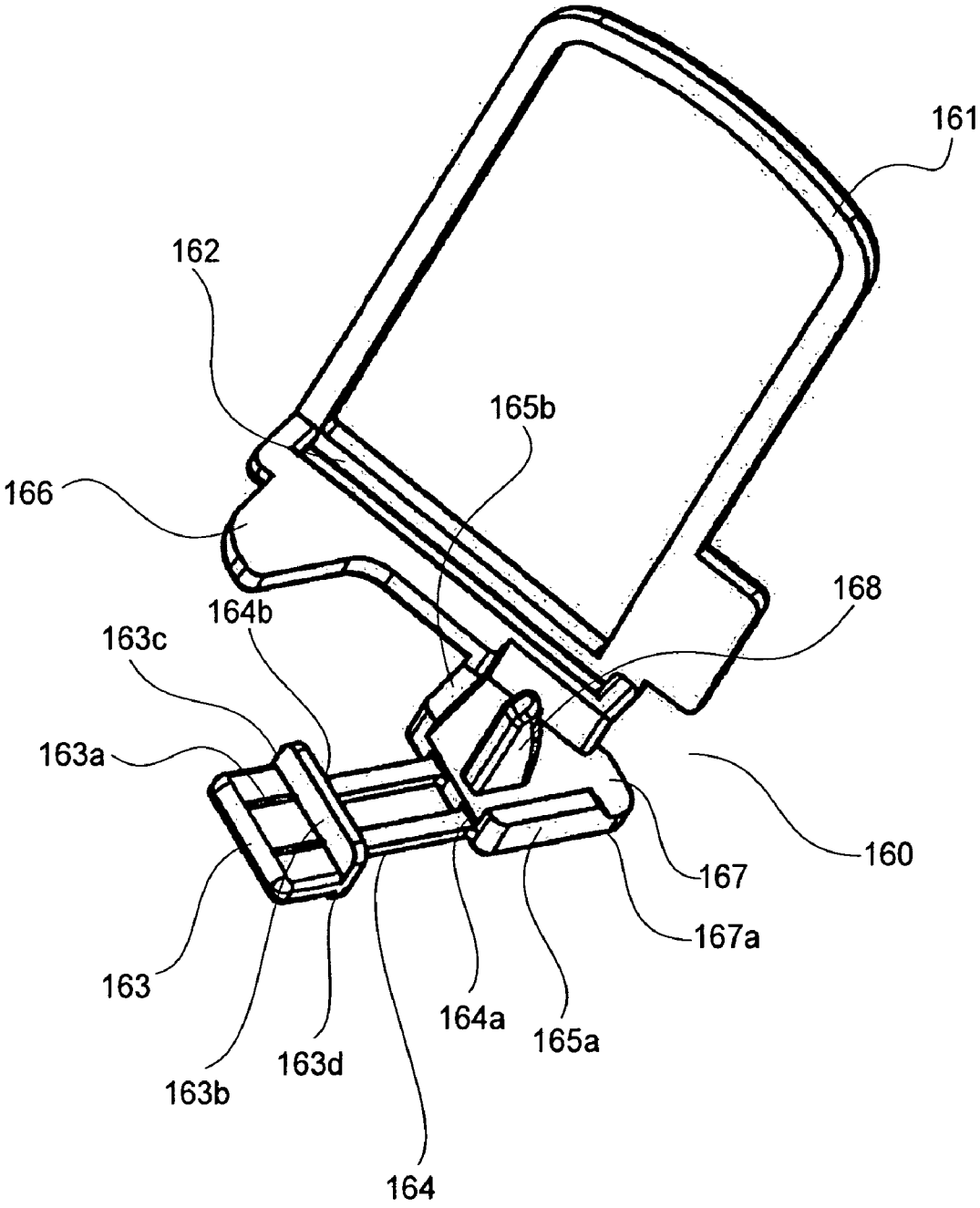
FIG. 5 is a schematic perspective view of the handgrip in the first embodiment of the present invention.

Referring to FIG. 5, the handgrip 160 is made up of a handgrip proper 161 which is roughly in the form of a ring, and a portion having a slit 162 for attaching the handgrip 160 to the toner seal 150. The handgrip 160 is also provided with a pressure application portion 167 having a rib 168 which projects perpendicular to the surface of the pressure application portion 167. The pressure application portion 167 extends from the portion having the slit 162. Further, the handgrip 160 is provided with an anchor portion 163, which is pressed into the bearing member 30 to anchor the handgrip 160 to the bearing member 30. The anchor portion 163 and pressure application portion 167 are connected by a flexible connective portion 164. A user can remove the toner seal 150 by pulling the handgrip 160 by gripping the handgrip proper 161. As the toner seal 150 is removed, the opening 48 becomes exposed, that is, the opening 48 is unsealed.

Figure 6:
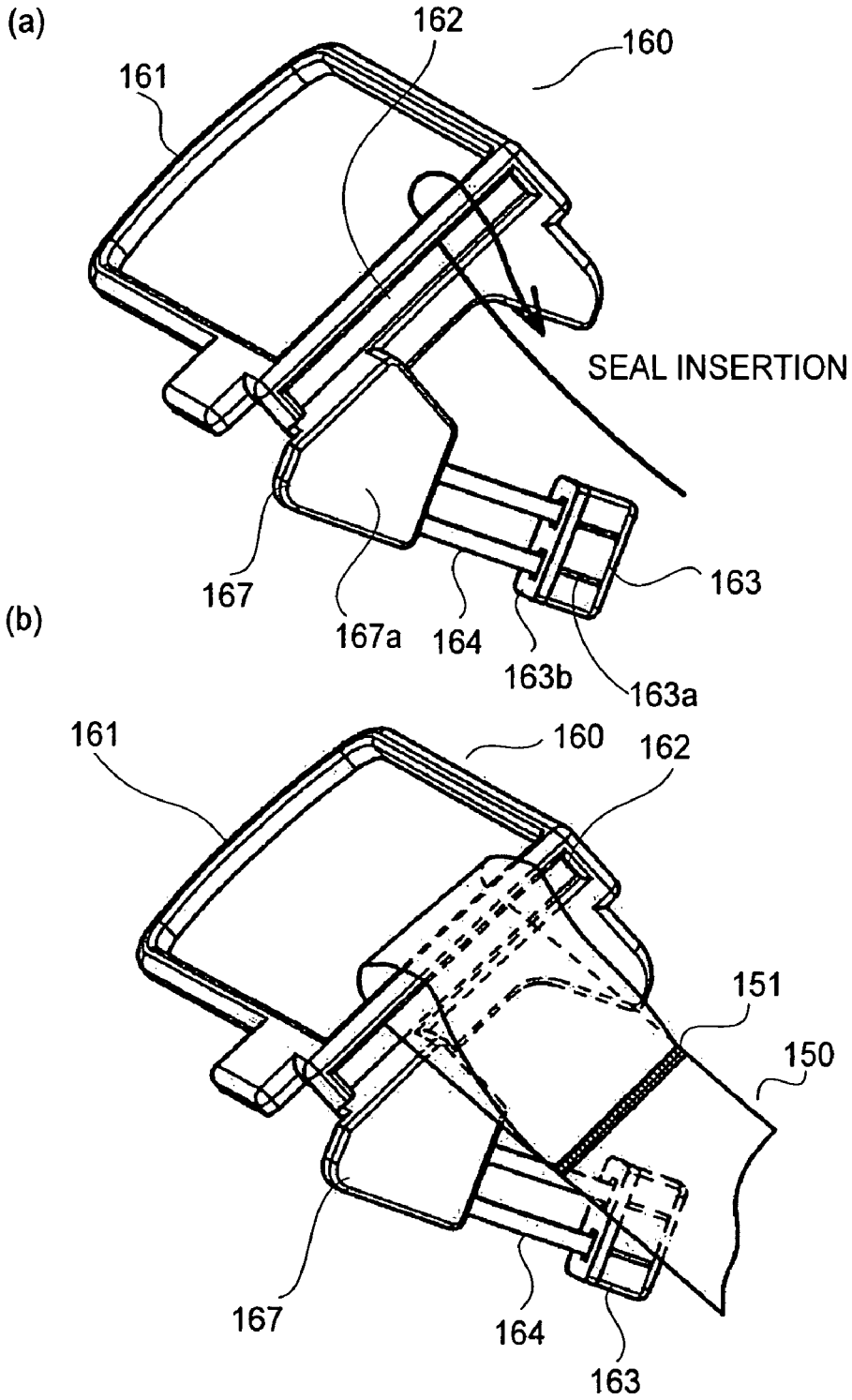
FIG. 6 is a schematic perspective view of the handgrip and toner seal in the first embodiment of the present invention, showing the method for attaching the handgrip to the toner seal.

Referring to FIG. 6, as for the method for attaching the handgrip 160 to the toner seal 150, the end portion of the doubled portion of the toner seal 150 is put through the slit 162, and is doubled. Then, the end of this double portion is welded to the welding portion 151 of the first doubled portion of the toner seal 150, creating a loop.

(Structure Arrangement for Supporting Spring and Handgrip with Bearing Member)

Figure 7:
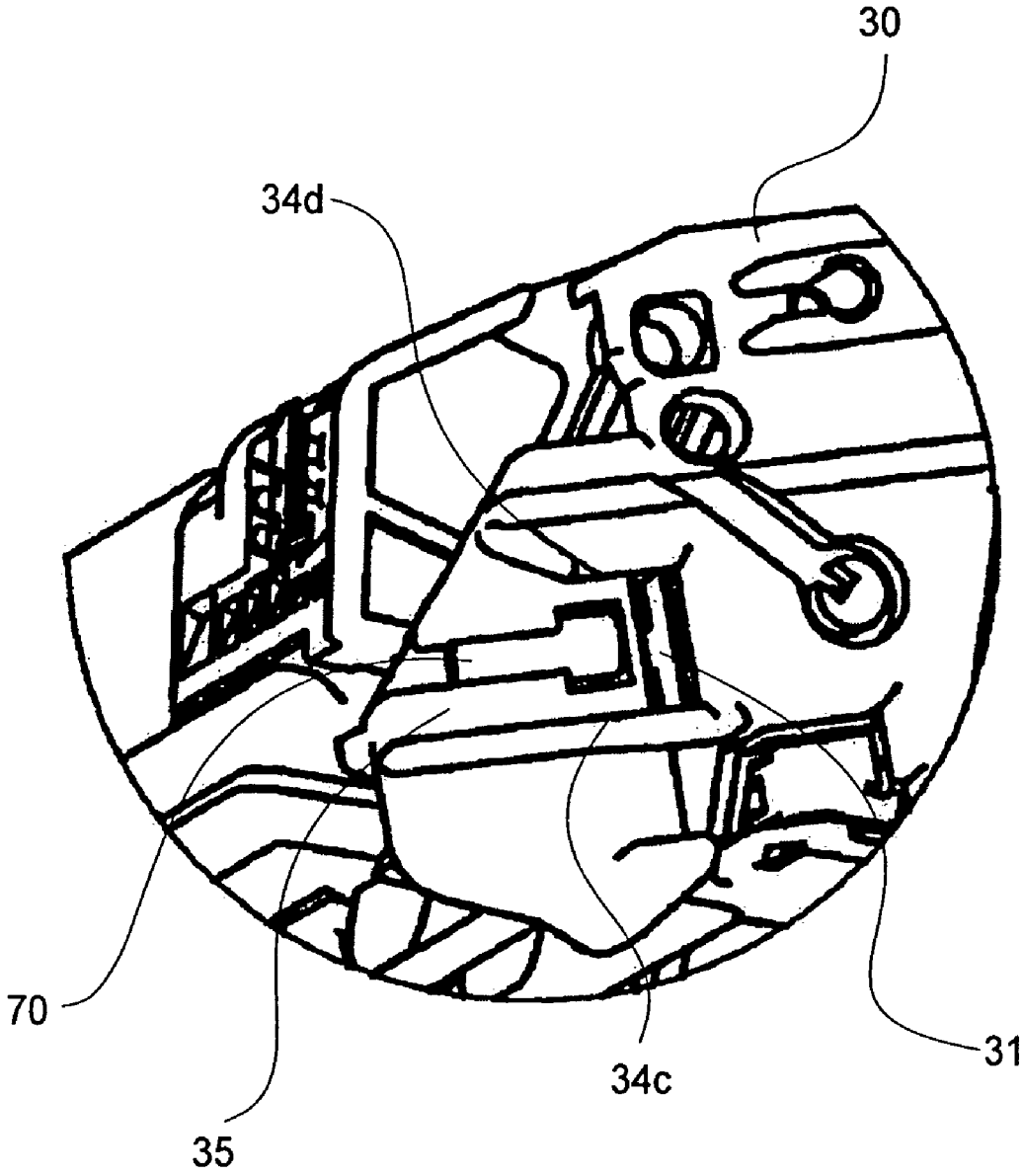
FIG. 7 is a schematic sectional view of the bearing member in the first embodiment of the present invention.

Referring to FIG. 7, the bearing member 30 is provided with a slit 31. The handgrip 160 can be firmly anchored to the bearing member 30 by pressing the anchor portion 163 into this slit 31 of the bearing member 30 in a manner to crush the crushable ribs 163*a* with which the anchor portion 163 is provided (FIG. 5). Incidentally, the anchor portion 163 in this embodiment is provided with a total of four crushable ribs 163*a*, two on the front side and two on the back side.

Figure 10:
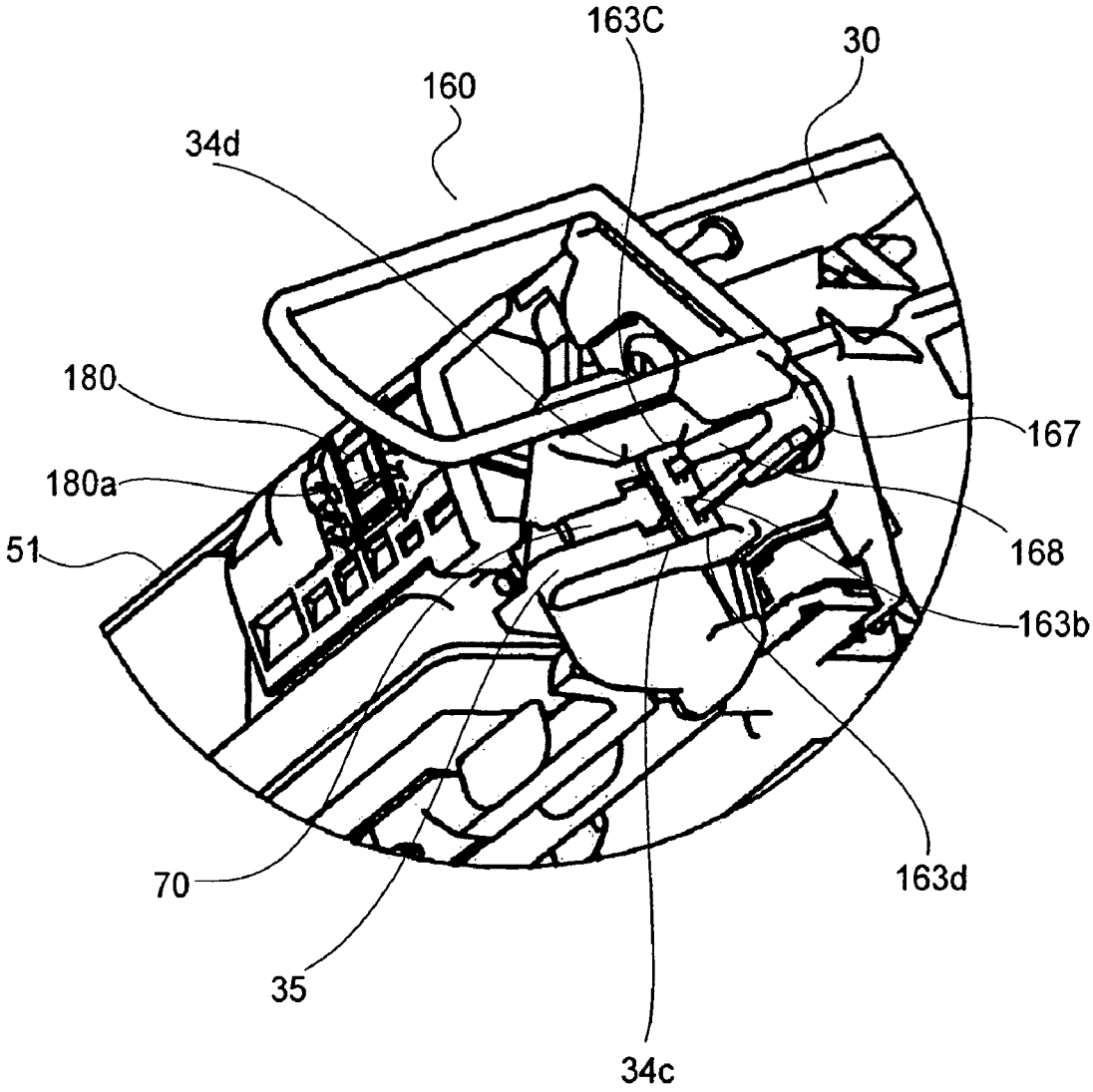
FIG. 10 is a schematic perspective view of the bearing member and handgrip in the first embodiment of the present invention, showing how the handgrip is attached to the bearing member.

The anchor portion 163 is provided with a flange like regulating portion 163*b*, which is located next to the connective portion 164. Thus, as the anchor portion 163 is pressed into the slit 31, the regulating portion 163*b* comes into contact with the surface 35 of the bearing member 30, as shown in FIG. 10, preventing the anchor portion 163 from being further inserted. After the completion of the process of pressing the anchor portion 163 into the slit 31, the anchor portion 163 and the bearing member 30 are in contact with each other so that the size of the contact area between the two equals the product of the length equal to the distance between the lengthwise ends 163*c* and 163*d* of the regulating portion 163*b* and the length equal to the distance between the inward surfaces 34*c* and 34*d* of the recess of the bearing member 30. Therefore, even if the connective portion 164 is bent as sharply as roughly perpendicularly, at the border 164*a* (FIG. 12(*a*)) between the connective portion 164 and regulating portion 163*b*, the handgrip 160 will not disengage from the bearing member 30.

Figure 8:
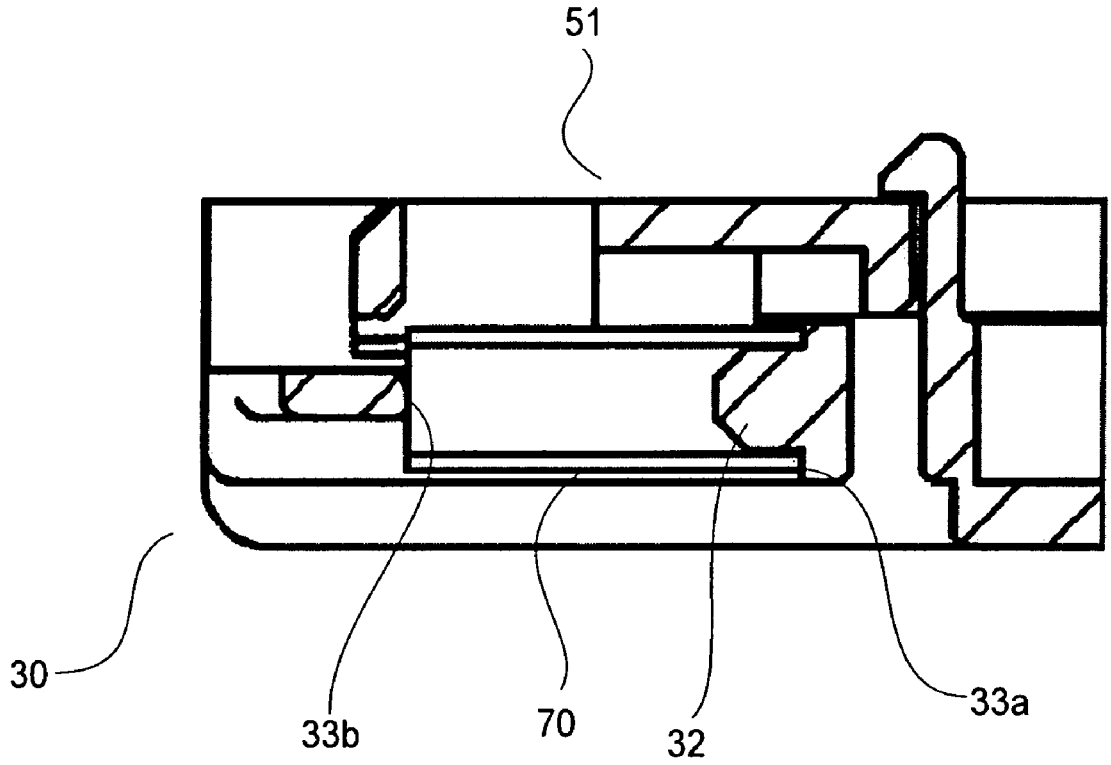
FIG. 8 is a sectional view of the bearing member 30 in the first embodiment of the present invention, at a vertical plane coinciding the axial line of the spring, showing the method for supporting the spring.
Figure 9:
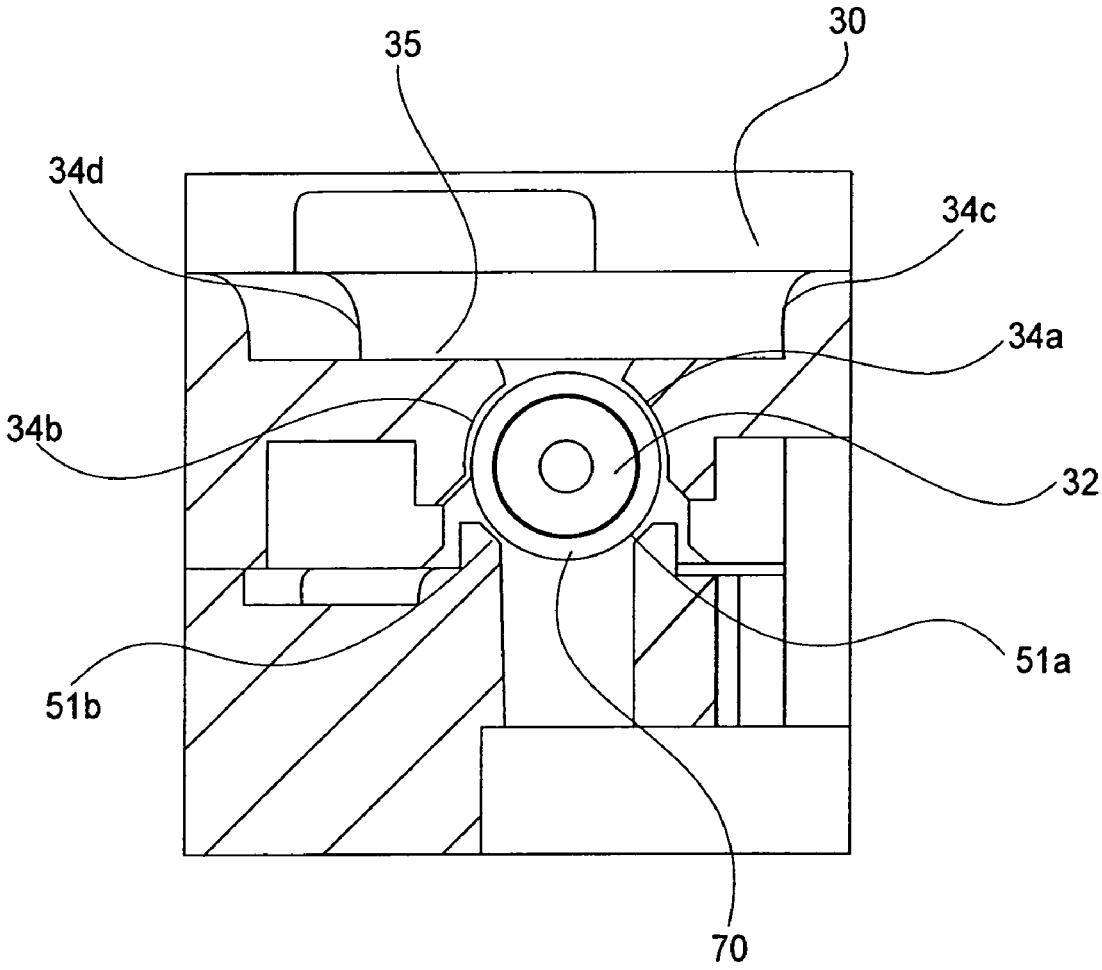
FIG. 9 is a sectional view of the bearing member 30 in the first embodiment of the present invention, at a plane perpendicular to the axial line of the spring, showing the method for supporting the spring.

Referring to FIG. 8, the bearing member 30 is provided with a spring 70 for elastically pressing the rib 168. The spring 70 is a compression spring, and is fitted around a spring supporting boss 32, being thereby positioned so that the axial line of the spring 70 roughly coincides with that of the boss 32. It is placed between surfaces 33*a* and 33*b* of the bearing member 30, with its lengthwise ends pressing on the surfaces 33*a* and 33*b*, being thereby held to the bearing member 30 by its own resiliency (the distance between surfaces 33*a* and 33*b* is smaller than spring 70 in its uncompressed state). Referring to FIG. 9, in terms of the direction perpendicular to the axial line of the spring 70, the position of the 70 is controlled by the rough guide portions 34*a* and 34*b* of the bearing member 30, and the rough guide portions 51*a* and 51*b* of the cleaning unit frame 51.

(Positioning of Handgrip and Structural Arrangement for Causing Handgrip to Pop Up)

After the cartridge 7 is mounted in the apparatus main assembly 100 in order to transport an image forming apparatus, the handgrip 160 is in a first position P1, in which the handgrip 160 allows the cartridge 7 to be inserted into the apparatus main assembly 100. However, as the cartridge 7 is moved out of the apparatus main assembly 100, the handgrip 160 is automatically moved by the resiliency of the above described spring 70 from the first position P1 to a second position P2, in which it protrudes outward from the bearing member 30. Next, this structure arrangement for automatically moving the handgrip from the first position P1 to the second position P2 will be described.

Referring to FIG. 10 (in which toner seal is not shown), when the cartridge 7 is assembled, the handgrip 160 is attached to the bearing member 30 by the anchor portion 163 alone. Therefore, the handgrip proper 161 remains roughly perpendicular to the anchor portion 163, providing a substantial distance between the handgrip proper 161 and bearing member 30.

When an image forming apparatus is shipped, the image forming apparatus is packed with the cartridge 7 mounted in the apparatus main assembly 100. Shipping an image forming apparatus with the cartridge 7 mounted in the apparatus main assembly 100, as described above, makes it possible to reduce the amount of the packing material and the amount of the space necessary for the transportation of an image forming apparatus.

Figure 11:
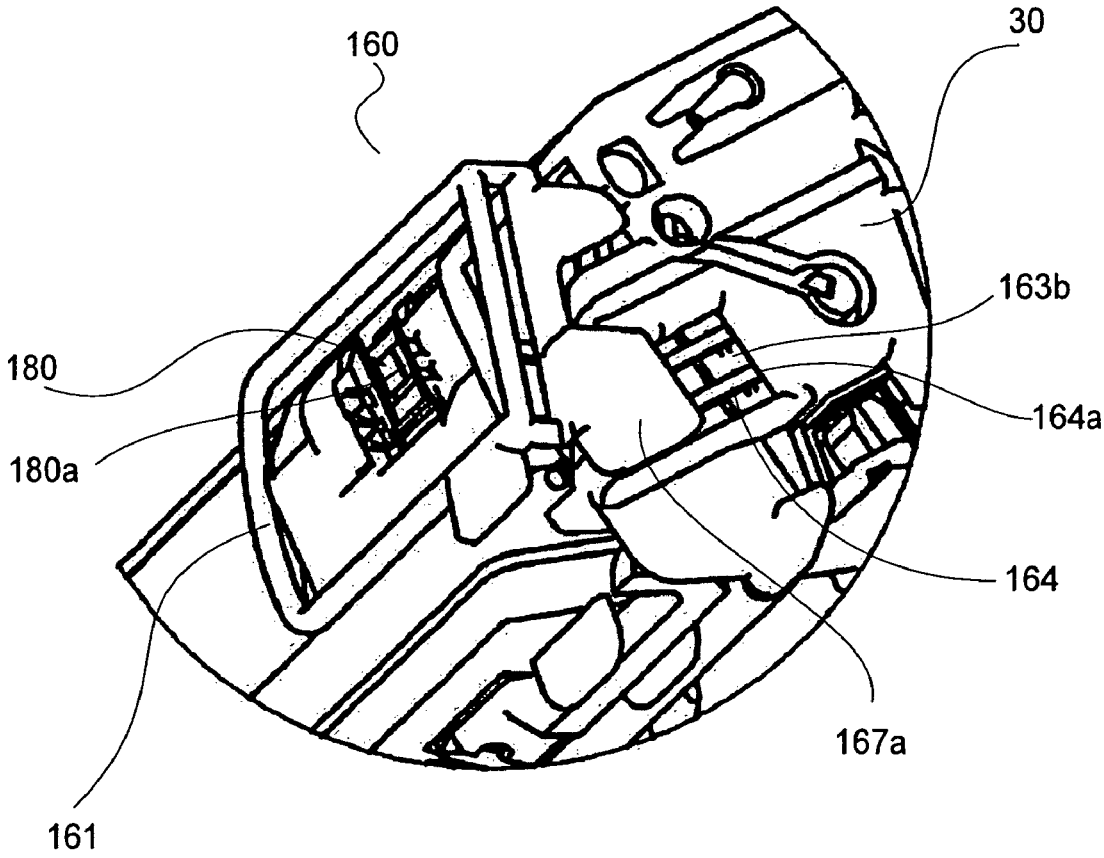
FIG. 11 is a schematic perspective view of the bearing member and handgrip in the first embodiment of the present invention, showing the position and shape of the handgrip after the cartridge is mounted into the main assembly of an image forming apparatus to pack the cartridge and image forming apparatus in the same box for shipment.

Referring to FIG. 11, the cartridge 7 in this embodiment is provided with a memory 180, in which the information regarding the cartridge 7 is stored. The memory 180 is attached to the external surface of the leading end of the cartridge 7. In terms of the direction in which the cartridge 7 is inserted into the apparatus main assembly 100, the memory 180 is attached near the portion of the cartridge 7, to which the handgrip 160 is attached. Examples of the information regarding the cartridge 7 are the lot number of the cartridge 7, the properties of the apparatus main assembly 100, the properties of the processing means, etc. The memory 180 is provided with a contact 180*a*. As the cartridge 7 is mounted into the apparatus main assembly 100, the contact 180*a* comes into contact with a contact, with which the apparatus main assembly 100 is provided, establishing electrical contact between the memory 180 and apparatus main assembly 100 to transmit the information in the memory 180 to the apparatus main assembly 100.

Also referring to FIG. 11, when the cartridge 7, which is brand new, is mounted into the apparatus main assembly 100, which is to be packed for transportation, the connective portion 164 is roughly perpendicularly bent at the border 164*a* between the regulating portion 163*b* and connective portion 164. Regarding the positions of the memory 180 and its contact 180*a* relative to the cartridge 7, the memory 180 and its contact 180*a* are positioned so that as the connective portion 164 is bent as described above, they will be positioned within the loop of the handgrip proper 161 of the handgrip 160, which is in the form of a ring. In other words, when the handgrip 160 is moved into the first position, it avoids the memory 180 and its contact 180*a*. Therefore, when the cartridge 7 is in the proper position in the apparatus main assembly 100, the handgrip 160 does not interfere with the electrical connection between the contact 180*a* of the memory 180 and the contact of the apparatus main assembly 100.

Next, referring to FIGS. 12(*a*)-12(*c*), how the handgrip 160 is made (allowed) to pop up into the second position P2 will be described.

Figure 12:
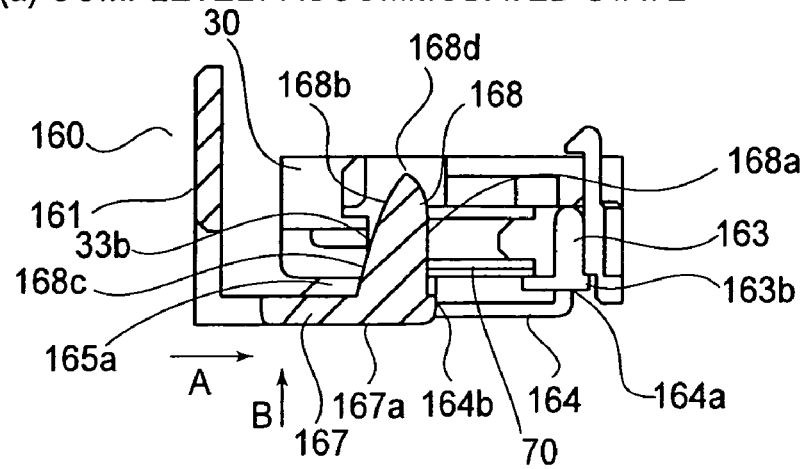
FIGS. 12(*a*)-12(*c*) are schematic sectional views of the bearing member and handgrip in the first embodiment of the present invention, showing how the handgrip is made to pop up.
Figure 12:
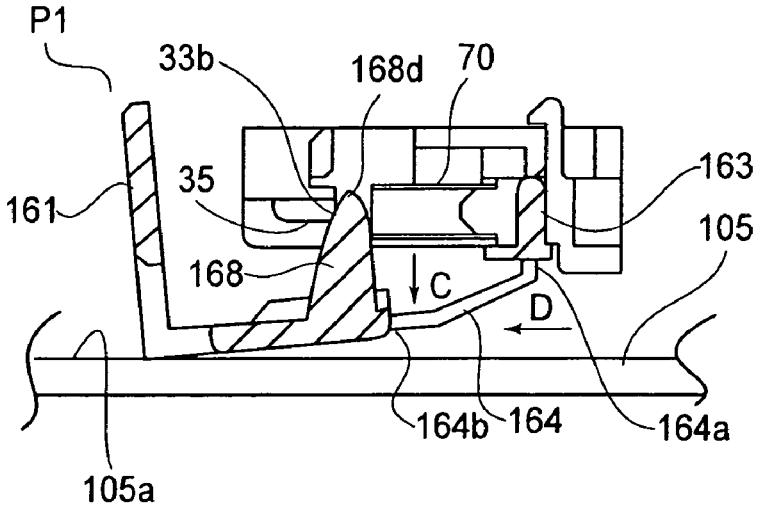
Figure 12:
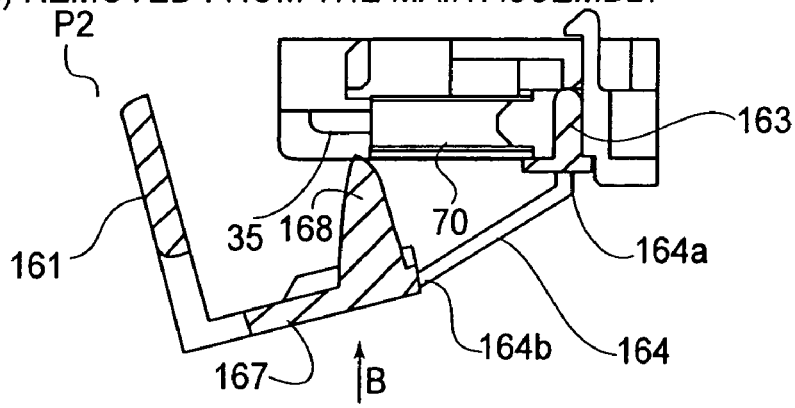

First, referring to FIG. 12(*a*), in order to pack the image forming apparatus with the cartridge 7 mounted in the apparatus main assembly 100, the outward surface 167*a* of the pressure application portion 167 of the handgrip 169 is to be pressed in the direction indicated by an arrow mark B before inserting the cartridge 7 into the apparatus main assembly 100. As the pressure application portion 167*a* is pressed in the abovementioned direction, the tip of the rib 168 enters between the spring 70 and surface 33*b* (FIG. 8), and advances further into the bearing member 33 while compressing the compression spring 70.

Also referring to FIG. 12(*a*), as the rib 168 is entirely inserted, that is, the handgrip 160 is moved into the first position P1, the projections 165*a* and 165*b* (FIG. 5) of the pressure application portion 167, which are on the inward surface of the pressure application portion 167 come into contact with the outward surface of the bearing member 30, controlling thereby the depth by which the rib 168 is allowed to enter the bearing member 30. Further, when the handgrip 160 is moved from its position shown in FIG. 10 to its position shown in FIG. 12(*a*), the rib 168 is to be inserted between the surface 33*b* and one of the lengthwise end of the spring 70 while compressing the spring 70. Therefore, force has to be applied to the handgrip 160 in the directions indicated by arrow marks A and B. As the handgrip 160 is moved into the first position P1 by the application of force in the abovementioned directions, it becomes possible for the brand new cartridge 7 to be mounted in the apparatus main assembly 100 so that the cartridge 7 can be packed in the same box as the box in which the apparatus main assembly 100 is packed for shipment.

The length of the elastically deformable connective portion 164 is greater than the distance between the border 164*a* between the regulating portion 163*b* and connective portion 164, and the border 164*b* between the pressure application portion 167 and connective portion 164, when the handgrip 160 is in the position shown in FIG. 12(*a*). Therefore, when the handgrip is in the position shown in FIG. 12(*b*), force works in the direction indicated by an arrow mark D in FIG. 12(*b*). Further, the surface of the rib 168 of the handgrip 160, which is on the spring side, is subjected to 100 gf-500 gf of force generated by the resiliency of the spring 70. This force is changed in direction by the slanted surfaces 168*b* and 168*c* of the rib 168, which are on the side opposite to the surface 168*a*, pressing therefore the rib 168 in the direction (indicated by arrow mark C) to cause the rib 168 to pop up outward of the bearing member 30.

Incidentally, the surface 168*a* of the rib 168 (surface opposite from slanted surfaces), which is on the spring 70 side of the rib 168, is rendered flat and parallel to the end surface of the spring 70 to ensure that the pressure generated by the spring 70 is caught by the rib 168 without being wasted at all.

Because the rib 168 is tapered as described above, the force applied to the pressure application portion 167 in the direction indicated by the arrow mark D as shown in FIG. 12(*b*) is changed in direction by the utilization of the slanted surfaces 168*b* and 168*c*, so that it acts in the direction indicated by the arrow mark C. Thus, when the cartridge 7 is mounted into the apparatus main assembly 100, the handgrip 160 is allowed to protrude into the position, shown in FIG. 12(*b*), in which it is prevented by the guiding surface 105*a* of the guide 105 of the apparatus main assembly 100, from protruding further, and remains in this position. When the handgrip 160 is in this position, the tip 168*d* of the rib 168 is located more inward of the bearing member 30 than the surface 35 of the bearing member 30.

Figure 13:
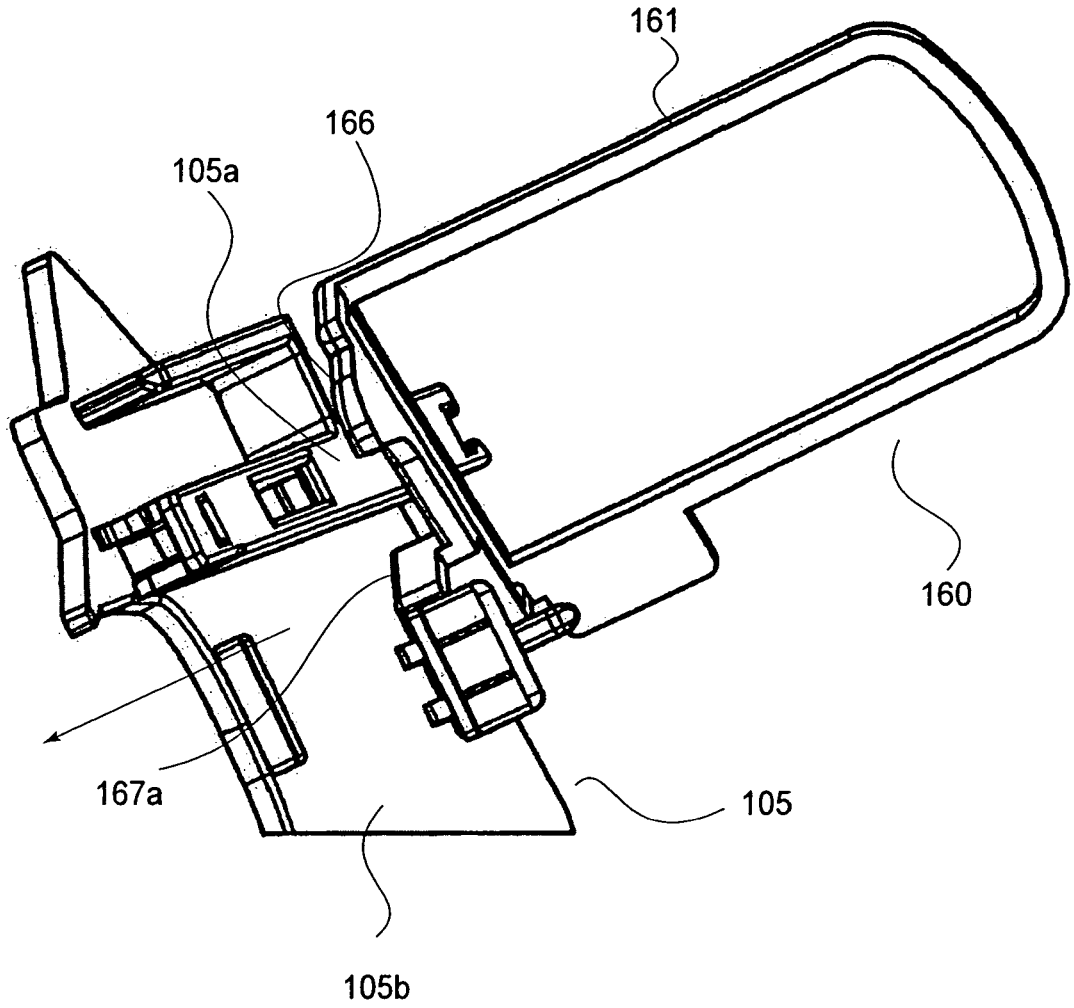
FIG. 13 is a schematic perspective view of the handgrip and the guide of the main assembly, showing their relationship.

Next, referring to FIG. 13, while the cartridge 7 is moved out of the apparatus main assembly 100 after the removal of the image forming apparatus from the shipment box, the guiding surface 105*a* of the apparatus main assembly 100 remains in contact with the surface 166 of the handgrip 160 and the outward surface 167*a* of the pressure application portion 167, keeping thereby the handgrip 160 in the state shown in FIG. 12(*b*).

Then, as soon as the cartridge 7 is completely moved out of the apparatus main assembly 100, the rib 168 is pushed out by the resiliency of the abovementioned springs 70 into the position, shown in FIG. 12(*c*), in which the tip of the 168*d* is out of the bearing member 30. This position of the tip of the rib 168 corresponds to the aforementioned second position P2 of the handgrip 160. When the handgrip 160 is in this position, or the second position P2, it protrudes outward, becoming easier to grip.

When the handgrip 160 is in this position, the outermost edge of the handgrip 160 is more outward of the bearing member 30 than the guide 105 of the main assembly 100. Therefore, if a user attempts to reinsert the cartridge 7 into the apparatus main assembly 100 when the handgrip 160 is in this position, the handgrip 160 collides with the guide 105 of the apparatus main assembly 100, preventing thereby the user from further inserting the cartridge 7. As a result, it is ensured that the user realizes that the handgrip 160 is a member which must be removed. Also when the handgrip 160 is in this position, the tip of the rib 168 is in contact with the surface 35, or the peripheral surface of the spring 70, and therefore, simply pressing the handgrip 160 in the direction indicated by an arrow mark B indicated in FIG. 12(*c*) is not enough to put the rib 168 back into the bearing member 30.

Thus, once the brand-new cartridge 7 is removed from the apparatus main assembly 100, it cannot be remounted into the apparatus main assembly 100, unless the user removes the toner seal 150 by gripping the handgrip 160; in other words, as long as the toner seal 150 remains attached to the cartridge 7, the cartridge 7 cannot be remounted into the apparatus main assembly 100, ensuring that the user realizes that the handgrip 160 is such a removable member that must be removed before the cartridge 7 is used for the first time, if the cartridge 7 is brand new.

Further, the resiliency of the spring 70 is used to automatically move the handgrip 160 from the first position P1 to the second position P2 as soon as the cartridge 7 is completely moved out of the apparatus main assembly 100. In other words, a complicated structural arrangement is not employed to move the handgrip 160 into the second position P2; all that is necessary to move the handgrip 160 into the second position P2 is to move the cartridge 7 out of the apparatus main assembly 100. Further, in this embodiment, the spring 70 is employed as the means for keeping the handgrip 160 under pressure, ensuring that the handgrip 160 is moved into the second position P2.

Incidentally, in the above, the structural arrangements, which requires the handgrip 160 to be placed in the first position P1 at the beginning of the insertion of the cartridge 7 into the apparatus main assembly 100, is described. In other words, in the case of the above described structural arrangement, it is only after the cartridge 7 is moved out of the apparatus main assembly 100 that the handgrip 160 is allowed to assume the second position P2.

However, a structural arrangement may be made so that the handgrip 160 is forced to assume the first position P1 as the cartridge 7 is inserted to a preset position in the apparatus main assembly 100. In other words, the structural arrangement may be such that the handgrip 160 is allowed to assume the second position P2 before the cartridge 7 is completely moved out of the apparatus main assembly, that is, as soon as the cartridge 7 in the apparatus main assembly 100 is moved outward to the preset position, because even when the cartridge 7 is at the abovementioned preset point, it is possible for a user to realize that the handgrip 160 must be removed. Here, the preset position may be the image formation position of the cartridge 7. However, it is preferable that the preset position is a certain distance away from the image formation position of the cartridge 7.

Embodiment 2

Next, referring to FIGS. 14 and 15, the apparatus in the second embodiment of the present invention will be described. The apparatus in this embodiment is identical in basic structure to that in the first embodiment. Therefore, the structural features of the apparatus in this embodiment, which are similar to those of the apparatus in the first embodiment will not be described to avoid the repetition of the same descriptions, and only the structural features that characterize this embodiment will be described. Further, the structural members in this embodiment, which are identical in function to those in the first embodiment, will be given the same reference symbols as those given in the first embodiment.

Figure 14:
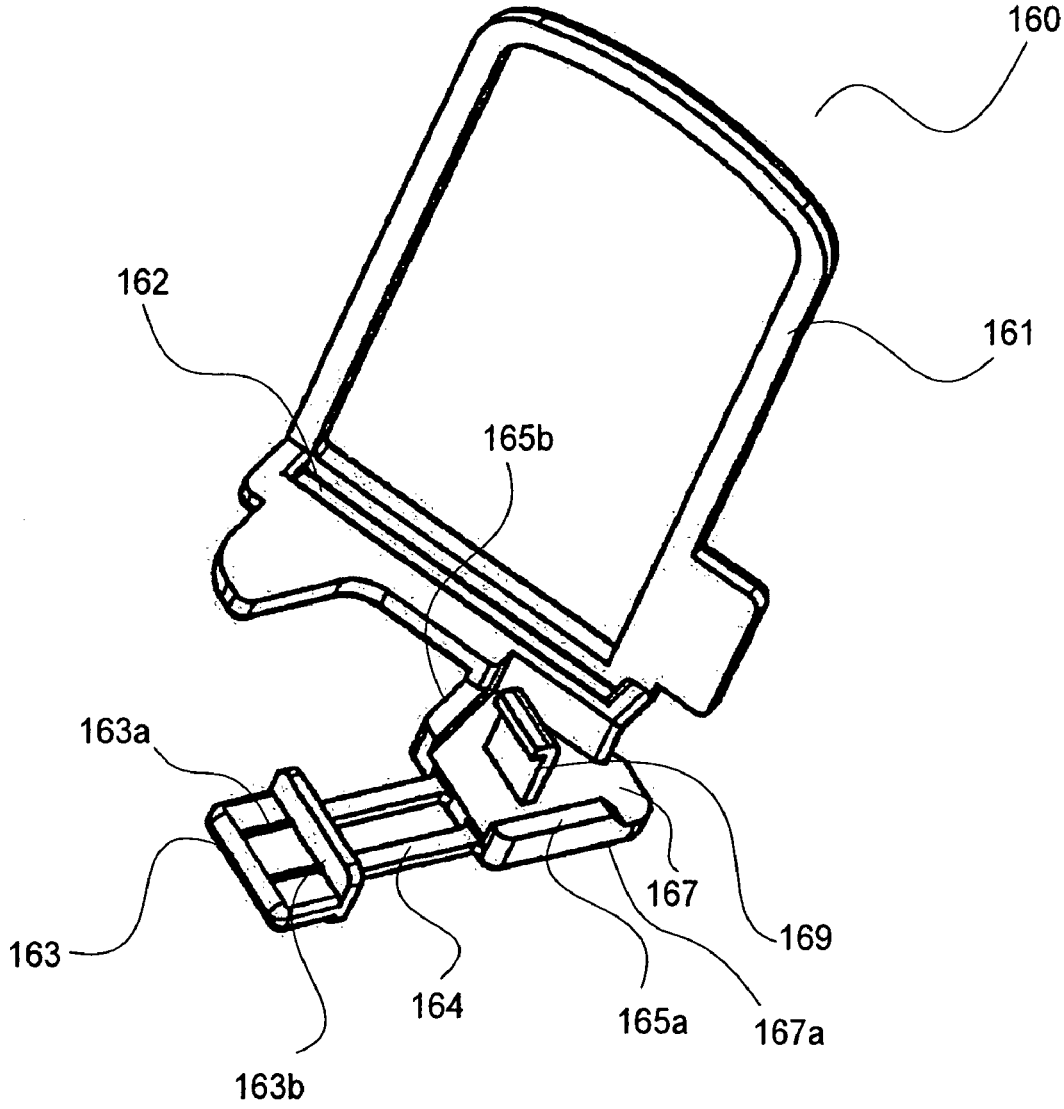
FIG. 14 is a schematic perspective view of the handgrip in the second embodiment of the present invention.

Referring to FIG. 14, the handgrip 160 in this embodiment is made up of a handgrip proper 161, which is to be gripped by a user, an anchor portion 163, by which the handgrip 160 is anchored to the bearing member 30, a slit 162 for attaching the handgrip 160 to the toner seal 150, and a pressure application portion 167. The anchor portion 163 is provided with a connective portion 164 for allowing the handgrip proper 161 to change in position and angle relative to the bearing member 30. This embodiment is different from the above described first embodiment in that the pressure application portion 167 in this embodiment is provided with elastically deformable projection 169, instead of a rib like the rib 168 in the first embodiment.

At this time, referring to FIGS. 15(*a*)-15(*c*), the structural arrangement, in this embodiment, which causes the handgrip 160 to pop up, will be described. If the cartridge 7 is brand new, pressure is to be applied to the outward surface 167*a* of the pressure application portion 167 from the direction indicated by an arrow mark B, to put the handgrip 160 in the position, shown in FIG. 15(*a*), that is, to completely retract the handgrip 160. As the pressure is applied as described above, the elastic projection 169 projecting from the pressure application portion 167 comes into contact with the outward surface of the bearing member 30, and is elastically bent by the outward surface of the bearing member 30. The extent of the bending of the elastic projection 169 is determined by the projections 165*a* and 165*b* (FIG. 14), with which the inward side of the pressure application portion 167 is provided; the elastic projection 169 is bent until the projections 165*a* and 165*b* come into contact with the outward surface of the bearing member 30.

The bending of the elastic projection 169 is regulated by the provision of the projections 165*a* and 165*b* so that the elastic projection 169 is bent within the limit of its elasticity. Therefore, when the elastic projection 169 remains bent as described above, the resiliency of the elastic projection 169 continuously generates such force that acts to move the handgrip 160 (in the direction indicated by arrow mark C in FIG. 15(*b*)). Thus, when the cartridge 7 is in the apparatus main assembly 100, the handgrip 160 is in the position, shown in FIG. 15(*b*), in which it is made to protrude from the bearing member 30 by the resiliency of the elastic projection 169, and in which it is kept by the guide 105 of the apparatus main assembly 100 and the resiliency of the elastic projection 169.

Figure 15:
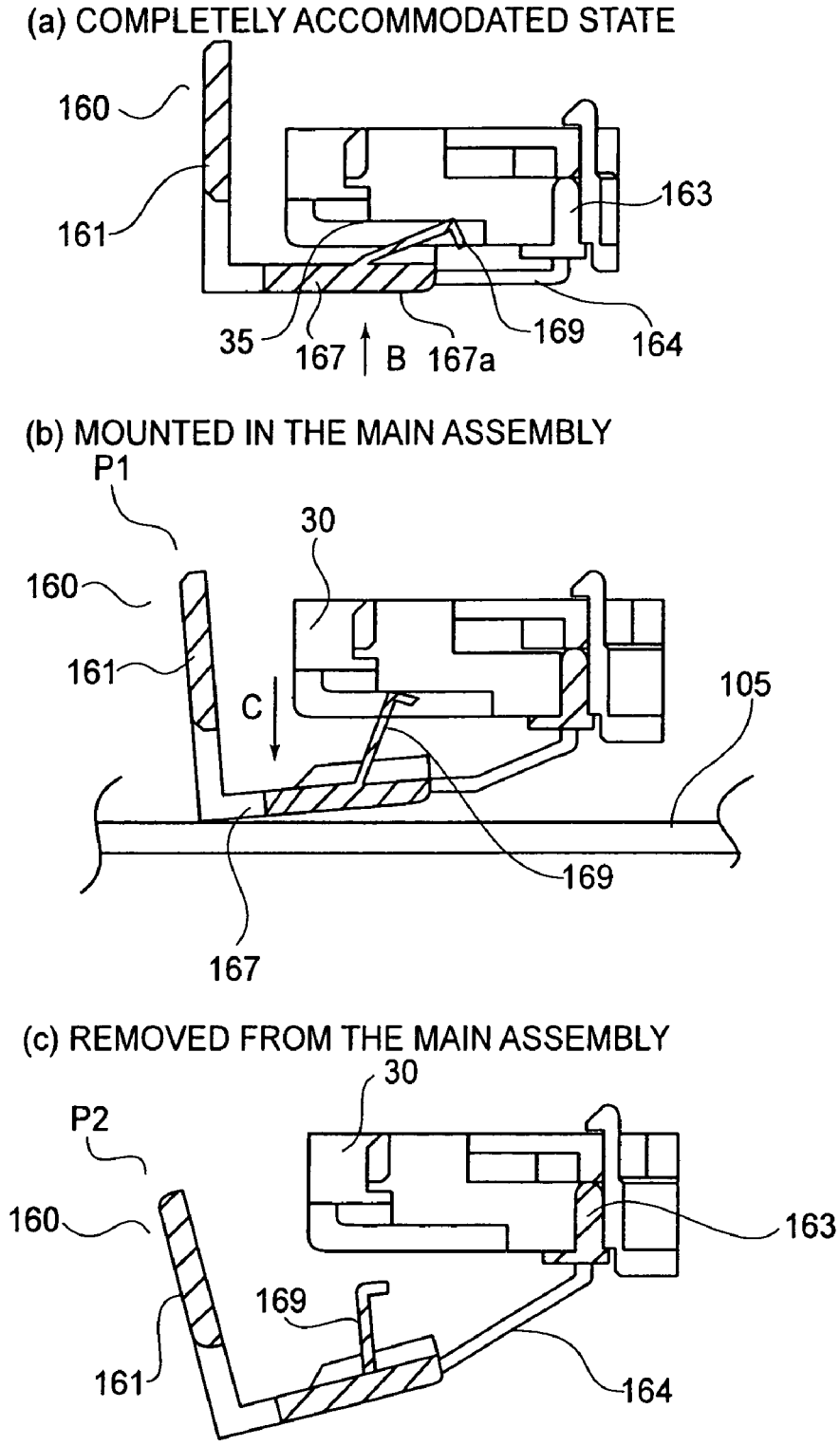
FIGS. 15(*a*)-15(*c*) are schematic sectional views of the handgrip and the bearing member in the second embodiment of the present invention, showing how the handgrip is made to pop up.

While the cartridge 7 is moved out of the apparatus main assembly 100, the surface 105*a* of the guiding member 105 of the apparatus main assembly 100 remains in contact with the surface 166 of the handgrip 160 and the outward surface 167*a* of pressure application portion 167, keeping thereby the handgrip 160 in the state shown in FIG. 15(*b*).

Then, as soon as the cartridge 7 is completely moved out of the apparatus main assembly 100, the elastic projection 169, which was remaining bent, is restored by its resiliency into its normal shape shown in FIG. 15(*c*). When the handgrip 160 is in the position shown in FIG. 15(*c*), the outermost edge of the handgrip 160 is located further outward of the bearing member 30 than the guide 105 of the main assembly 100. Therefore, if a user attempts to reinsert the cartridge 7 into the apparatus main assembly 100 when the handgrip 160 is in this position, the handgrip 160 collides with the guide 105 of the apparatus main assembly 100, preventing thereby the user from further inserting the cartridge 7. As a result, the user is made to realize that the handgrip 160 is a member which must be removed.

Further, a structural arrangement such as the above described structural arrangement which uses the resiliency of the elastic projection 169 to cause the handgrip 160 to pop up eliminates the need for providing the bearing member 30 with the spring 70, making it possible to simplify the cartridge 7 in structure. Further, the elastic projection 169 can be molded, as an integral part of the handgrip 160, of resin or the like substance, making it possible to further simplify the cartridge 7 in structure.

Miscellaneous Embodiments

In the above described first and second embodiments, the cartridge 7 was structured so that the handgrip 160 was moved from the first position P1 to the second position P2 by the resiliency of the spring 70 and the resiliency of the elastic projection 169, respectively. However, the cartridge 7 does not need to be structured so that the handgrip 160 is moved from the first position P1 to the second position P2 by the resiliency of a structural member.

For example, the first embodiment may be modified as follows: The pressure application portion 167 is provided with a bearing member engaging projection, instead of the rib 168. The bearing member 30 is not provided with the spring 70; instead, it is provided with a handgrip engaging portion. Further, the cartridge 7 is structured so that as the handgrip 160 is moved into the first position to mount the cartridge 7 into the main assembly of an image forming apparatus to package the main assembly and cartridge 7 in the same box, the bearing member engaging projection of the pressure application portion 167 engages with the handgrip engaging portion of the bearing member 30. Thus, as the outward surface 167*a* of the pressure application portion 167 is pressed in the direction indicated by the arrow mark B in FIG. 12(*b*), the handgrip 160 is moved into the first position P1, and the bearing member engaging projection snappingly engages with the handgrip engaging portion, retaining thereby the handgrip 160 in the first position P1. As a result, the cartridge 7 can be mounted into the apparatus main assembly 100 without the need for keeping on pressing the outward surface 167*a* of the pressure application portion 167 while inserting the cartridge 7.

As for the apparatus main assembly 100, it is provided with a disengaging portion for moving the handgrip 160 into the second position P2 when the cartridge 7 is moved out of the apparatus main assembly 100. More specifically, when the cartridge 7 is moved out of the apparatus main assembly 100, the disengaging portion of the apparatus main assembly 100 disengages the abovementioned bearing member engaging projection from the handgrip engaging portion by coming into a specific portion of the handgrip 160. Thus, as soon as the cartridge 7 is completely moved out of the apparatus main assembly 100, the handgrip 160 moves into the second position P2, causing the outermost edge of the handgrip 160 to be positioned further outward of the bearing member 30 than the guide 106 of the apparatus main assembly 100. Moreover, even if the handgrip 160 is on the inward side of the guide 105 of the apparatus main assembly 100 when the handgrip 160 is in the second position P2, it collides with the abovementioned disengaging portion, preventing thereby the cartridge 7 from being further inserted into the apparatus main assembly 100.

With the employment of the above described structural arrangement, if a user attempts to reinsert the cartridge 7 into the apparatus main assembly 100, the handgrip 160 can be made to collide with the guide 105 of the apparatus main assembly 100, without using the resiliency of a structural member, preventing thereby the user from further inserting the cartridge 7 as in the first embodiment. As a result, the user is made to realize that the handgrip 160 is a member which must be removed. In other words, if the toner seal 150 of the cartridge 7 is left attached to the cartridge 7, the cartridge 7 cannot be mounted into the apparatus main assembly 100 to form an image.

Further, in each of the preceding embodiments, the electrophotographic image forming apparatus was an apparatus which formed an image on recording medium with the use of an electrophotographic image forming method. As examples of an electrophotographic image forming apparatus, an electrophotographic copying machine, an electrophotographic printer (for example, laser beam printer, LED printer, etc.), a facsimile apparatus, a word processor, etc., can be included.

A process cartridge is a cartridge in which an electrophotographic photosensitive drum, and at least one developing means (development roller) as the processing means for processing the electrophotographic photosensitive drum, are integrally disposed, and which is removably mountable in the main assembly of an electrophotographic image forming apparatus. As the examples of the processing means, there are a charging means, a cleaning means, etc., in addition to the developing means.

The preceding embodiments of the present invention were described with reference to a process cartridge. However, the present invention is also applicable to a development cartridge which has the development roller 40, and the developer storage portion 41 having the developer supply outlet 48, and which is removably mountable in the apparatus main assembly 100.

According to the present invention, as a brand new cartridge is removed from the main assembly of an electrophotographic image forming apparatus, the handgrip of the toner seal of the cartridge 7 is moved from the first position to the second position, making it easier to grip the handgrip. Therefore, the sealing member of the cartridge can be easily removed.

Also according to the present invention, once a brand new process cartridge is removed from the main assembly of an electrophotographic image forming apparatus, it cannot be remounted into the main assembly unless the sealing member of the cartridge is removed, that is, as long as the sealing member remains attached to the cartridge. Therefore, it is ensured that if a user forgets to remove the sealing member before remounting the cartridge into the main assembly, the user is reminded that the sealing member must be removed before the remounting of the cartridge into the main assembly.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 155091/2005 filed May 27, 2005 which is hereby incorporated by reference.

What is claimed is:

1. A process cartridge which is detachably mountable to a main assembly of an electrophotographic image forming apparatus and which is transportable in a state of being mounted to the main assembly of the electrophotographic image forming apparatus, said process cartridge comprising:

an electrophotographic photosensitive member;

a developing roller configured and positioned to develop an electrostatic latent image formed on said electrophotographic photosensitive member with a developer;

a developer accommodating portion accommodating the developer and having a developer supply opening configured and positioned to permit passage of the developer to supply the developer to said developing roller;

a sealing member configured and positioned to unsealably seal said developer supply opening; and a grip member, provided on said sealing member, and configured and positioned to be gripped to unseal said developer supply opening when said sealing member is removed from said developer supply opening, wherein said grip member is movable between a first position where said process cartridge is permitted to move to a predetermined position in the main assembly of the apparatus to permit transportation of said process cartridge in the state of being mounted to the main assembly of the electrophotographic image forming apparatus, and a second position where said process cartridge is prevented from moving to the predetermined position, wherein said grip member moves from the first position to the second position by an elastic force when said process cartridge is removed from the predetermined position.

2. A process cartridge according to claim 1, wherein the elastic force is provided by a spring member.

3. A process cartridge according to claim 2, wherein said grip member integrally includes:

a ring like grip portion;

a slit portion configured and positioned to lock locking said sealing member;

a seat portion;

a rib, provided projected from said seat portion, configured and positioned to receive the elastic force to guide said ring like grip portion from the first position to the second position;

a connecting portion connecting with a cartridge frame; and a deformable connecting portion configured and positioned to connect said connecting portion and said seat portion with each other, wherein said ring like grip portion is inclined relative to said seat portion.

4. A process cartridge according to claim 3, wherein said rib is urged by said spring member, and a surface thereof urged by said spring member is substantially straight, and an opposite side thereof is tapered.

5. A process cartridge according to claim 1 or 2, wherein said grip member integrally includes:

a ring like grip portion;

a slit portion configured and positioned to lock said sealing member;

a seat portion;

an elastic projection, provided on said seat portion, configured and positioned to guide said ring-like grip portion from the first position to the second position by an elastic force thereof;

a connecting portion connecting with a cartridge frame; and a deformable connecting portion configured and positioned to connect said connecting portion and said seat portion with each other, wherein said ring-like grip portion is inclined relative to said seat portion.

6. A process cartridge according to claim 1, wherein said grip member has a ring like grip portion, and wherein a contact portion, provided on a cartridge frame, configured and positioned to electrically connect with the main assembly of the electrophotographic image forming apparatus, is disposed inside said grip member when said grip member is at the first position.

7. A process cartridge according to claim 1, wherein the predetermined position is a position at which said process cartridge starts moving into the main assembly of the apparatus.

8. A developing cartridge which is detachably mountable to a main assembly of an electrophotographic image forming apparatus and which is transportable in a state of being mounted to the main assembly of the electrophotographic image forming apparatus, said developing cartridge comprising:

a developing roller configured and positioned to develop an electrostatic latent image formed on an electrophotographic photosensitive member with a developer;

a developer accommodating portion accommodating the developer and having a developer supply opening configured and positioned to permit passage of the developer to supply the developer to said developing roller;

a sealing member unsealably sealing said developer supply opening; and a grip member, provided on said sealing member, configured and positioned to be gripped to unseal said developer supply opening when said sealing member is removed from said developer supply opening, wherein said grip member is movable between a first position where said developing cartridge is permitted to move to a predetermined position in the main assembly of the apparatus to permit transportation of said developing cartridge in the state of being mounted to the main assembly of the electrophotographic image forming apparatus, and a second position where said developing cartridge is prevented from moving to the predetermined position, and wherein said grip member moves from the first position to the second position by an elastic force when said developing cartridge is removed from the predetermined position.

9. A developing cartridge according to claim 8, wherein the elastic force is provided by a spring member.

10. A developing cartridge according to claim 9, wherein said grip member integrally includes:

a ring like grip portion;

a slit portion configured and positioned to lock said sealing member;

a seat portion;

a rib, provided projected from the seat portion, configured and positioned to receive the elastic force to guide said ring like grip portion from the first position to the second position;

a connecting portion connecting with a cartridge frame; and a deformable connecting portion configured and positioned to connect said connecting portion and said seat portion with each other, wherein said ring like grip portion is inclined relative to said seat portion.

11. A developing cartridge according to claim 10, wherein said rib is urged by said spring member, and a surface thereof urged by said spring member is substantially straight, and an opposite side thereof is tapered.

12. A developing cartridge according to claim 8 or 9, wherein said grip member integrally includes:

a ring like grip portion;

a slit portion configured and positioned to lock said sealing member;

a seat portion;

an elastic projection, provided on said seat portion, configured and positioned to guide said ring like grip portion from the first position to the second position by an elastic force thereof;

a connecting portion connecting with a cartridge frame; and a deformable connecting portion configured and positioned to connect said connecting portion and said seat portion with each other, wherein said ring like grip portion is inclined relative to said seat portion.

13. A developing cartridge according to claim 8, wherein said grip member has a ring like grip portion, and wherein a contact portion, provided on a cartridge frame, configured and positioned to electrically connect with the main assembly of the electrophotographic image forming apparatus, is disposed inside said grip member when said grip member is at the first position.

14. A developing cartridge according to claim 8, wherein the predetermined position is a position where said developing cartridge starts to move into the main assembly of the apparatus.

15. An electrophotographic image forming apparatus for forming an image on a recording material, to which a process cartridge is detachably mountable, said apparatus comprising:

(a) said process cartridge including:

an electrophotographic photosensitive member, a developing roller configured and positioned to develop an electrostatic latent image formed on said electrophotographic photosensitive member with a developer;

a developer accommodating portion accommodating the developer and having a developer supply opening configured and positioned to permit passage of the developer to supply the developer to said developing roller;

a sealing member configured and positioned to unsealably seal said developer supply opening; and a grip member, provided on said sealing member, configured and positioned to be gripped to unseal said developer supply opening when said sealing member is removed from said developer supply opening, wherein said grip member is movable between a first position where said process cartridge is permitted to move to a predetermined position in said main assembly of said apparatus to permit transportation of said process cartridge in the state of being mounted to said main assembly of said electrophotographic image forming apparatus, and a second position where said process cartridge is prevented from moving to the predetermined position, wherein said grip member moves from the first position to the second position by an elastic force when said process cartridge is removed from the predetermined position; and (b) feeding means for feeding a recording material.

16. An electrophotographic image forming apparatus for forming an image on a recording material, to which a developing cartridge is detachably mountable, said apparatus comprising:

(a) said developing cartridge including:

a developing roller configured and positioned to develop an electrostatic latent image formed on an electrophotographic photosensitive member with a developer:

a developer accommodating portion accommodating the developer and having a developer supply opening configured and positioned to permit passage of the developer to supply the developer to said developing roller, a sealing member configured and positioned to unsealably seal said developer supply opening, and a grip member, provided on said sealing member, configured and positioned to be gripped to unseal said developer supply opening when said sealing member is removed from said developer supply opening, wherein said grip member is movable between a first position where said developing cartridge is permitted to move to a predetermined position in said main assembly of said apparatus to permit transportation of said developing cartridge in the state of being mounted to said main assembly of said electrophotographic image forming apparatus, and a second position where said developing cartridge is prevented from moving to the predetermined position, and wherein said grip member moves from the first position to the second position by an elastic force when said developing cartridge is removed from the predetermined position; and (b) feeding means for feeding a recording material.

* * * * *